US010646060B2

(12) United States Patent
Du

(10) Patent No.: US 10,646,060 B2
(45) Date of Patent: May 12, 2020

(54) CRADLE FRAME AND STRUCTURE

(71) Applicant: SHANGHAI XINTANG INDUSTRIAL CO., LTD, Shanghai (CN)

(72) Inventor: Chuankui Du, Shanghai (CN)

(73) Assignee: SHANGHAI XINTANG INDUSTRIAL CO., LTD, Shanghai (CN)

( * ) Notice: Subject to any disclaimer, the term of this patent is extended or adjusted under 35 U.S.C. 154(b) by 497 days.

(21) Appl. No.: 15/505,773

(22) PCT Filed: Feb. 2, 2015

(86) PCT No.: PCT/CN2015/072092
§ 371 (c)(1),
(2) Date: Feb. 22, 2017

(87) PCT Pub. No.: WO2016/026278
PCT Pub. Date: Feb. 25, 2016

(65) Prior Publication Data

US 2017/0273481 A1 Sep. 28, 2017

(30) Foreign Application Priority Data

Aug. 22, 2014 (WO) ..... PCT/CN2014/085021

(51) Int. Cl.
*A61G 13/12* (2006.01)
*A47G 9/10* (2006.01)
(Continued)

(52) U.S. Cl.
CPC ..... *A47G 9/1009* (2013.01); *A47C 20/026* (2013.01); *A47C 20/046* (2013.01);
(Continued)

(58) Field of Classification Search
CPC ..... A61G 13/12; A61G 9/00
(Continued)

(56) References Cited

U.S. PATENT DOCUMENTS 5,009,170 A 4/1991 Spehar
5,524,555 A 6/1996 Fanuzzi
(Continued)

FOREIGN PATENT DOCUMENTS

CN 201073424 Y 6/2008
CN 101849867 A 10/2010
(Continued)

OTHER PUBLICATIONS

Notice of Allowance dated Oct. 18, 2017 in U.S. Appl. No. 15/505,799.
(Continued)

*Primary Examiner* — Frederick C Conley
(74) *Attorney, Agent, or Firm* — Pillsbury Winthrop Shaw Pittman LLP

(57) ABSTRACT

Embodiments of cradle frames and cushions are described herein. A cradle frame includes a connection assembly, a support assembly, and a gear assembly. The connection assembly is configured to couple the cradle frame to a structure. The support assembly includes two side sections, and a middle section that is curved and positioned substantially between the two side sections. The gear assembly is coupled to the adjustment assembly for controlling the positioning of the support assembly. A cushion has a contoured upper side, and one or more opening in the middle part of the cushion on the underside.

19 Claims, 29 Drawing Sheets

(51) Int. Cl.

| | |
|---|---|
| ***A47C 20/02*** | (2006.01) |
| ***A47C 20/04*** | (2006.01) |
| *A61G 13/00* | (2006.01) |
| *A61H 37/00* | (2006.01) |

(52) U.S. Cl.
CPC ..... *A47G 9/10* (2013.01); *A47G 9/1054* (2013.01); *A61G 13/121* (2013.01); *A61G 13/009* (2013.01); *A61G 2200/325* (2013.01); *A61H 37/00* (2013.01)

(58) Field of Classification Search
USPC ..... 5/622, 636–640
See application file for complete search history.

(56) References Cited

U.S. PATENT DOCUMENTS

| | | | | |
|---|---|---|---|---|
| 5,676,062 | A | 10/1997 | Lloyd | |
| 5,943,965 | A | 8/1999 | Riach | |
| 5,974,979 | A | 11/1999 | Grady | |
| 6,000,345 | A | 12/1999 | Gillotti | |
| 6,076,472 | A | 6/2000 | Lloyd | |
| 6,705,234 | B1 | 3/2004 | Miller | |
| 7,036,168 | B1 * | 5/2006 | Knickerbocker ..... | A47G 9/10 5/636 |
| 7,761,943 | B2 * | 7/2010 | Roleder ..... | A61G 13/12 5/622 |
| 2006/0053557 | A1 | 3/2006 | Dernron | |
| 2006/0260053 | A1 | 11/2006 | Roleder et al. | |
| 2006/0288484 | A1 | 12/2006 | Roleder et al. | |
| 2008/0056959 | A1 * | 3/2008 | Cuthbert ..... | A45D 34/02 422/123 |
| 2009/0077749 | A1 | 3/2009 | Roleder et al. | |
| 2013/0269711 | A1 | 10/2013 | Porter et al. | |
| 2014/0190371 | A1 | 7/2014 | Woog | |

FOREIGN PATENT DOCUMENTS

| | | | |
|---|---|---|---|
| CN | 102293703 | A | 12/2011 |
| CN | 202760809 | U | 3/2013 |
| CN | 203970800 | U | 12/2014 |
| CN | 203979107 | U | 12/2014 |
| WO | 2008138298 | A2 | 12/2006 |

OTHER PUBLICATIONS

Extended European Search Report dated Dec. 14, 2017 in European Application 15833207.2.
Office Action dated Mar. 7, 2018 in Canadian Application 2958799.
Office Action dated Apr. 5, 2018 in Canadian Application 2968493.
Office Action dated Nov. 20, 2018 in Chinese Application 201580057598.0.
Office Action dated Sep. 11, 2019 in Chinese Application 201580057598.0.
Office Action dated Oct. 8, 2019 in Chinese Application 201480082876.3.
International Search Report dated May 19, 2015 in International Application PCT/CN2015/072092.
International Search Report dated Apr. 29, 2015 in International Application PCT/CN2014/085018.
International Search Report dated May 25, 2015 in International Application PCT/CN2015/085021.
International Preliminary Report on Patentability dated Feb. 28, 2017 in International Application PCT/CN2015/072092.
International Preliminary Report on Patentability dated Feb. 28, 2017 in International Application PCT/CN2014/085018.
International Preliminary Report on Patentability dated Fen. 28, 2017 in International Application PCT/CN2014/085021.

* cited by examiner

CRADLE FRAME AND STRUCTURE

CROSS REFERENCE TO RELATED APPLICATION

This application is a national stage application, filed under 35 U.S.C. § 371, of International Application No. PCT/CN2015/072092, filed on Feb. 2, 2015, which claims priority to International Application No. PCT/CN2014/085021, filed on Aug. 22, 2014, the entire contents of each of which are incorporated herein by reference.

BACKGROUND

1. Technical Field

The present teachings relate to cradle frames and cushions.

2. Discussion of Technical Background

A cradle frame and a cushion may be used separately or together in many systems or structures including, e.g., a massage table, a massage chair, and a table/bed or chair for medical or other uses, or the like. In such a system or structure, the cradle frame and the cushion may provide support for a subject or a part thereof.

SUMMARY

The teachings disclosed herein relate to cradle frames and cushions.

In one example, a cradle frame is provided. The cradle frame includes a connection assembly, a support assembly and a gear assembly. The connection assembly includes a first beam, a second beam, and a beam connector. The beam connector couples the first beam and the second beam. The support assembly includes a first side section, a second side section, and a middle section. The middle section is curved and positioned substantially between the first side section and the second side section. The gear assembly is configured to be coupled to the support assembly for controlling the positioning of the support assembly relative to the beam connector.

In another example, a cradle is provided. The cradle includes a cradle frame and a cushion. The cradle frame includes a connection assembly, a support assembly and a gear assembly. The connection assembly includes a first beam, a second beam, and a beam connector. The beam connector couples the first beam and the second beam. The support assembly includes a first side section, a second side section, and a middle section. The middle section is curved and positioned substantially between the first side section and the second side section. The gear assembly is configured to be coupled to the support assembly for controlling the positioning of the support assembly relative to the beam connector. The cushion includes a body. The body includes a first arm, a second arm, and a middle part having a thickness, a length, and a width. The middle part of the cushion, along the length of the middle part, is positioned substantially between and integrally formed with the first arm and the second arm. The middle part includes at least one opening on the underside of the body. The at least one opening extends partially through the width of the middle part. The at least one opening extends partially through the thickness of the middle part.

In another different example, a system is provided. The system includes a cradle frame and a structure. The cradle frame is coupled to the structure. The cradle frame includes a connection assembly, a support assembly and a gear assembly. The connection assembly includes a first beam, a second beam, and a beam connector. The beam connector couples the first beam and the second beam. The support assembly includes a first side section, a second side section, and a middle section. The middle section is curved and positioned substantially between the first side section and the second side section. The gear assembly is configured to be coupled to the support assembly for controlling the positioning of the support assembly relative to the beam connector.

Additional features will be set forth in part in the description which follows, and in part will become apparent to those skilled in the art upon examination of the following and the accompanying drawings or may be learned by production or operation of the examples. The features of the present teachings may be realized and attained by practice or use of various aspects of the structures and combinations set forth in the detailed examples discussed below.

BRIEF DESCRIPTION OF THE DRAWINGS

The cradle frames and cushions described herein are further described in terms of exemplary embodiments. These exemplary embodiments are described in detail with reference to the drawings. The drawings are not to scale. These embodiments are non-limiting exemplary embodiments, in which like reference numerals represent similar structures throughout the several views of the drawings, and wherein.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings. These and other details, as well as various exemplary embodiments of the present teachings, are discussed below in connection with FIGS. 1-15B. However, it is understood that it is not intended to limit the scope of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 1:
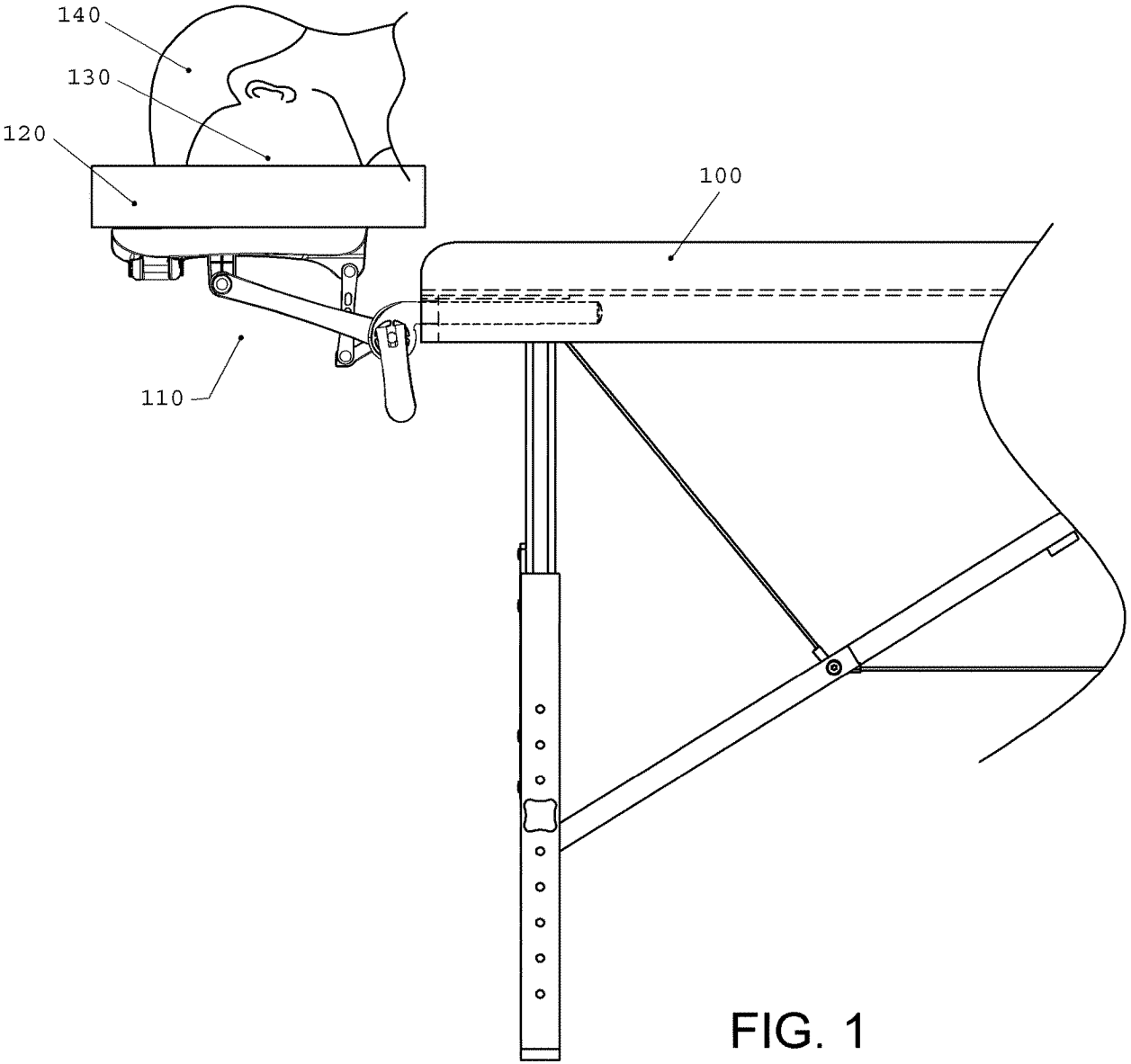
FIG. 1 is a simplified side view of a portion of a table with a cradle frame and a cushion according to some embodiments of the present teachings.

FIG. 1 is a simplified side view of a portion of a table 100 with a cradle frame 110 and a cushion 120. The table 100 includes a surface on which the body of a user (the body of the user not shown in FIG. 1) is supported, and the cradle frame 110 and the cushion 120 for supporting the head 140 of the user. As illustrated, the user is facing downward so that the user's face 130 is in contact with the cushion 120. The cradle frame 110 is coupled to the table. The cushion 120 is placed on the cradle frame 110. As used herein, the head of a user includes both the face and the back of the head of the user. The cradle frame and/or the cushion disclosed herein is suitable for use both when a user is facing upward and when the user is facing downward. A cradle frame and/or a cushion disclosed herein may be used in connection with a structure other than a table as illustrated in FIG. 1. Merely by way of example, a cradle frame and/or a cushion may be coupled to a chair, a wall, etc. A cradle frame and/or a cushion may be used to support a subject, or a part of a subject. The subject may be a person, an object other than a person.

FIGS. 2A-4C illustrate an exemplary cradle frame having features of the present teachings. A cushion is shown in some of these figures as well. The exemplary cradle frames illustrated in FIGS. 2A-4C are essentially symmetric except that the latch 220 is located closer to the first side section 201 of the support assembly 210 than to the second side section 202 of the support assembly 210. It is understood that it is not intended to limit the scope of the application.

Figure 2A:
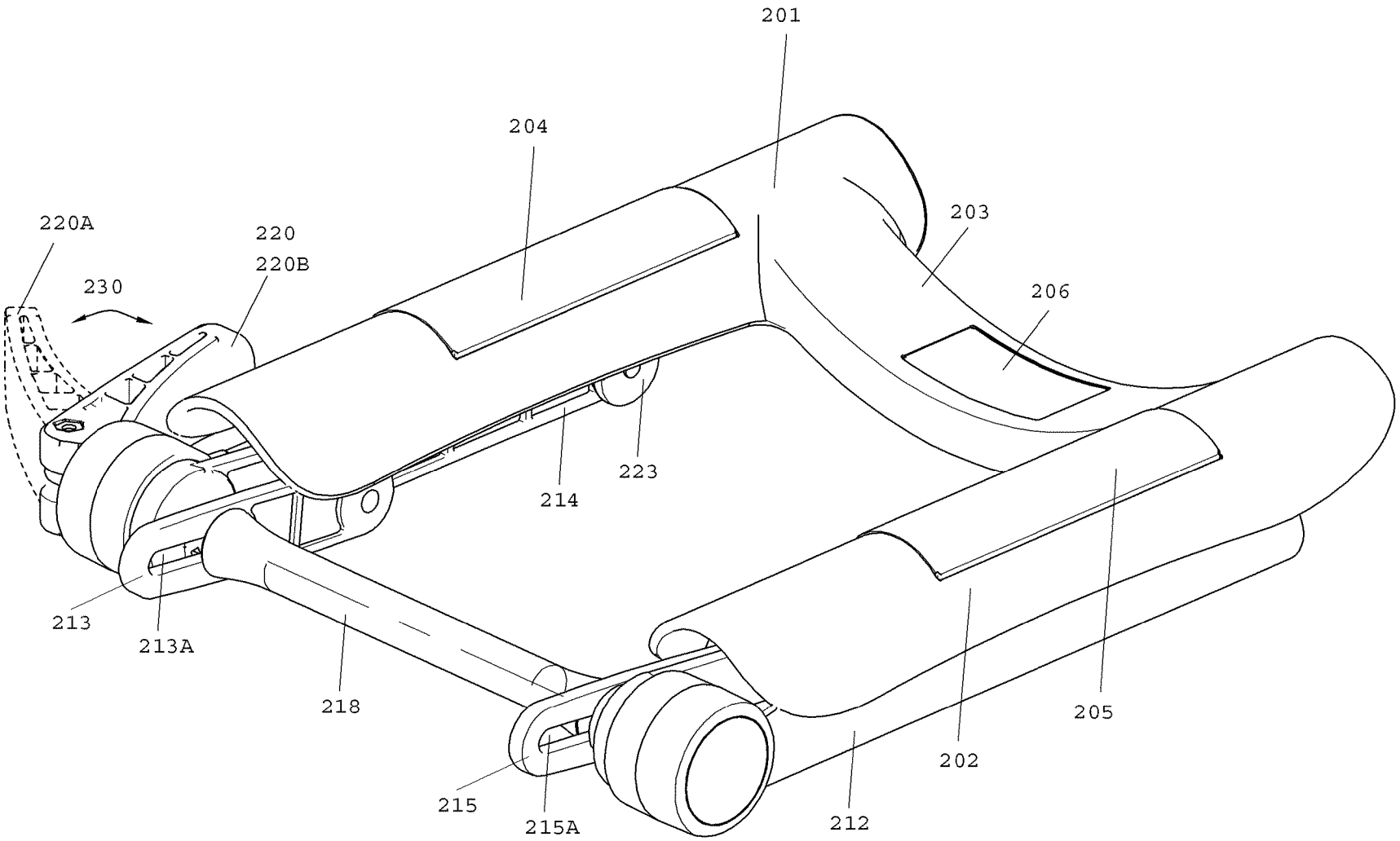
FIG. 2A shows an exemplary cradle frame with the beams of the connection assembly in a folded configuration according to some embodiments of the present teachings.
Figure 2B:
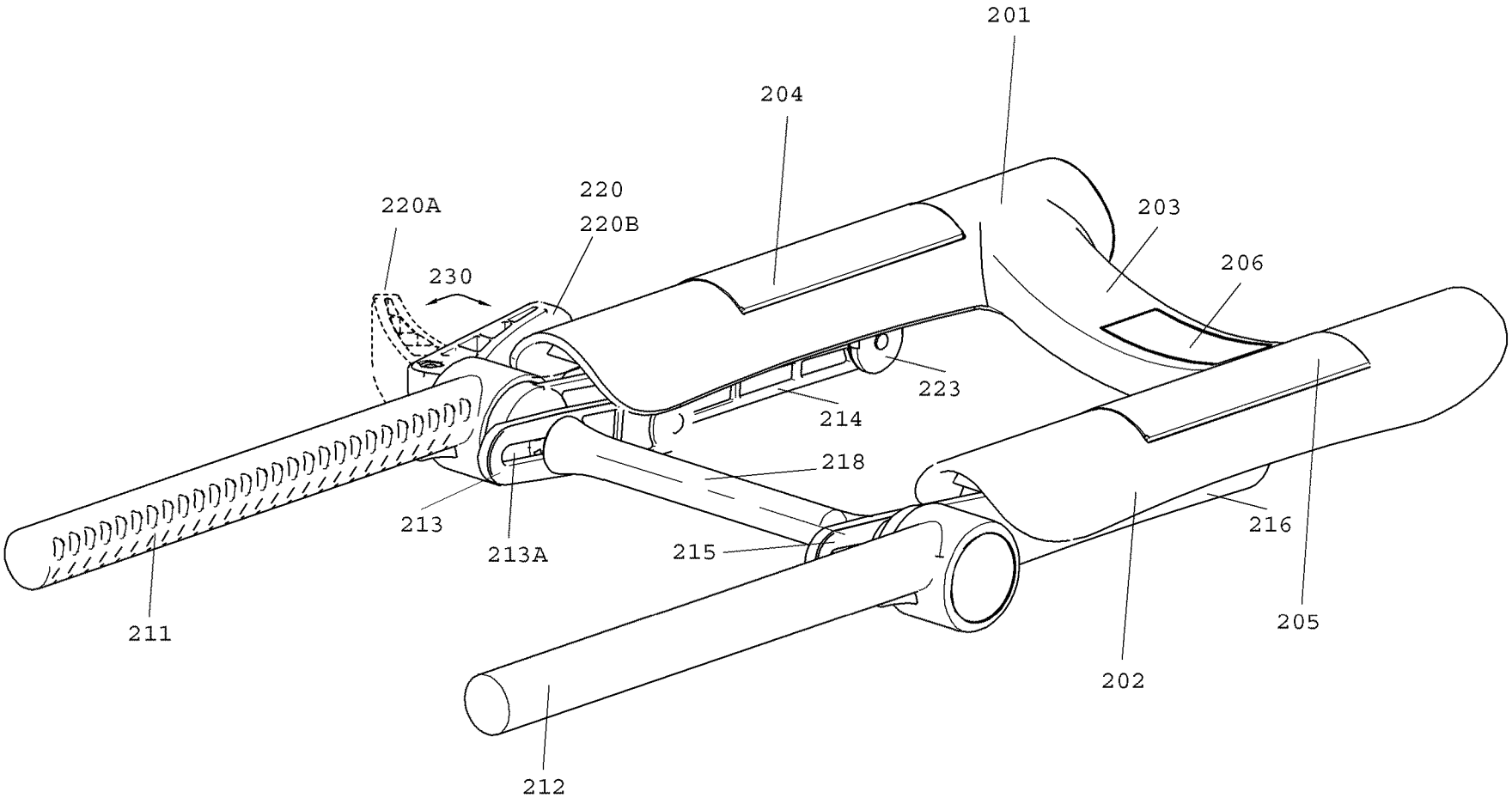
FIG. 2B shows an exemplary cradle frame in an unfolded configuration according to some embodiments of the present teachings.
Figure 2C:
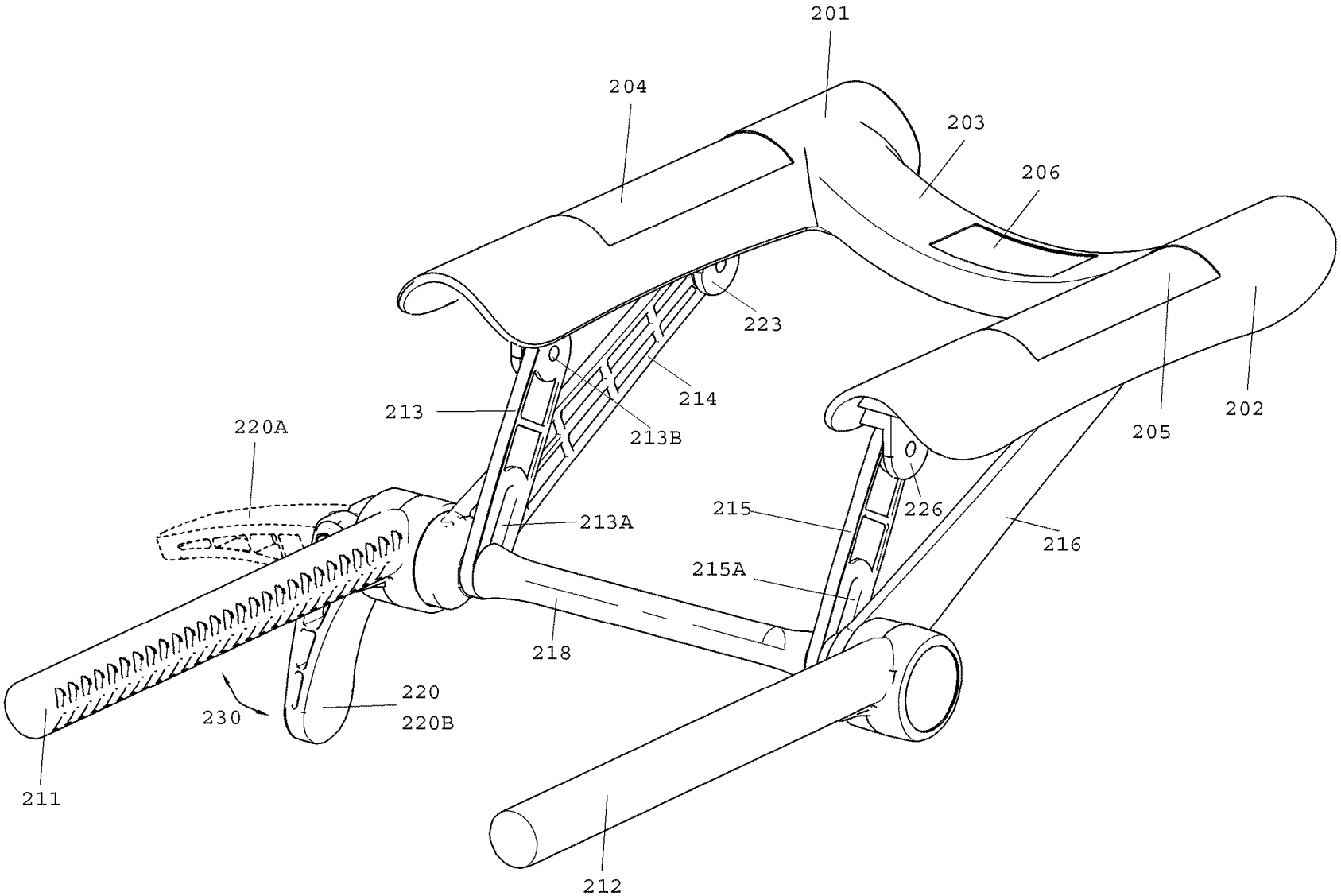
FIGS. 2C and 2D show an exemplary cradle frame in a raised position with the beams of the connection assembly in an unfolded configuration according to some embodiments of the present teachings.
Figure 2D:
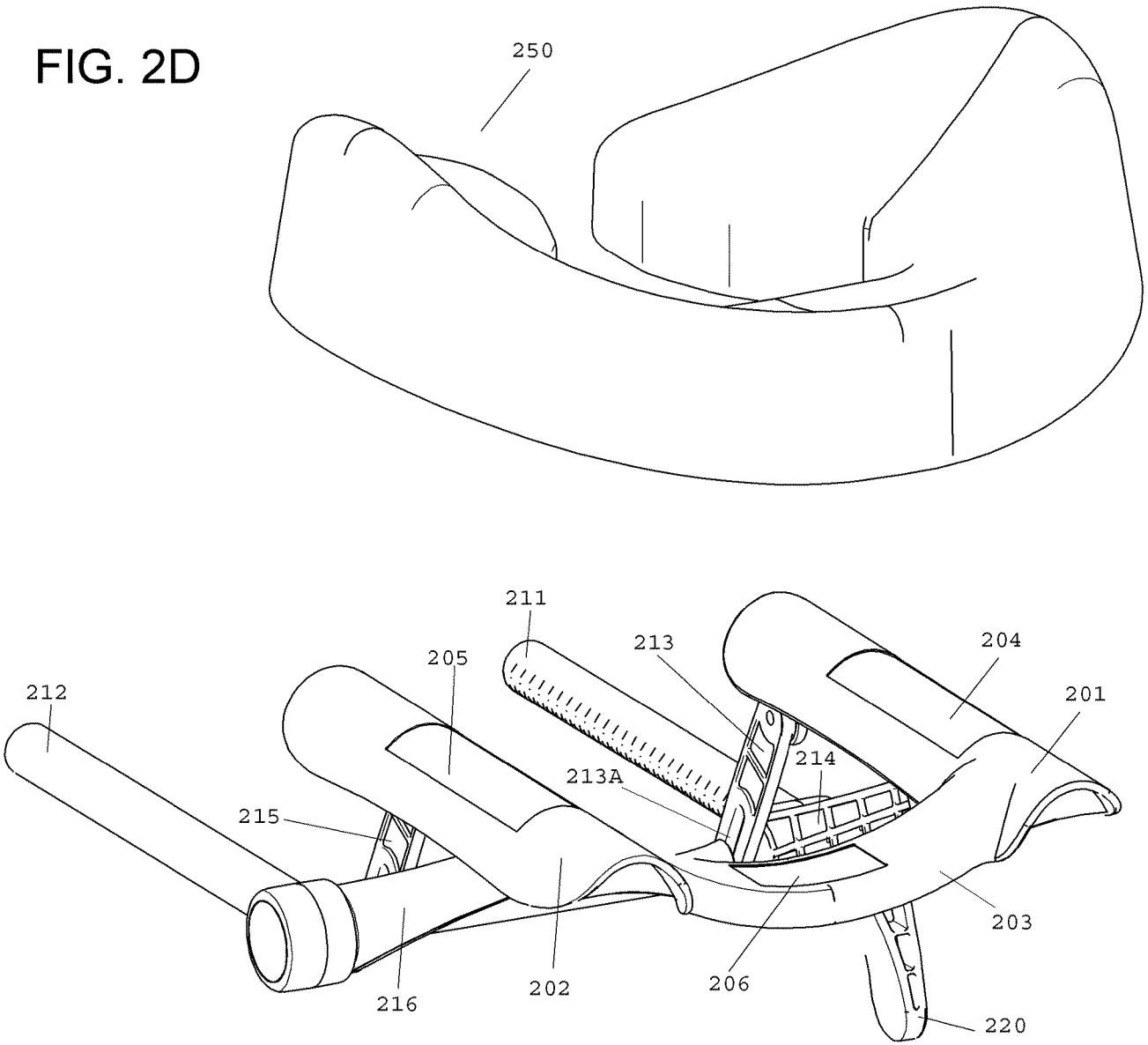

FIGS. 2A-2D illustrate perspective views of the exemplary cradle frame. As illustrated, the exemplary cradle frame includes a support assembly 210 (see also FIG. 4A), an adjustment assembly, a gear assembly, and a connection assembly. FIG. 2A shows the exemplary cradle frame with the beams 211 and 212 of the connection assembly in a folded configuration for, e.g., storage and/or transportation purposes. FIG. 2B shows the exemplary cradle frame in a lower (or unraised) position with the beams 211 and 212 of the connection assembly in an unfolded configuration, extended for coupling the cradle frame to a structure, e.g., the table 100 shown in FIG. 1. FIGS. 2C and 2D show the exemplary cradle frame in a higher (or raised) position with the beams 211 and 212 of the connection assembly in an unfolded configuration, extended for coupling the cradle frame to a structure, e.g., the table 100 shown in FIG. 1. FIG. 2D also shows a cushion 250 that may be used with the cradle frame. At least one of the support assembly 210, an adjustment assembly, a gear assembly, and a connection assembly, or components of any one of these assemblies may be made of a rigid material. Merely by way of example, the first side section 201, the second side section 202, and the middle section 203 of the support assembly 210 may be an integral piece made of, e.g., plastic, wood, metal, or the like. Plastic may include, e.g., nylon (e.g., PA6), or at least one of other types of polymers.

FIG. 2A shows the exemplary cradle frame with the beams 211 and 212 of the connection assembly in a folded configuration for, e.g., storage and/or transportation purposes. As shown in the figure, the support assembly 210 includes a first side section 201, a second side section 202, and a middle section 203. The middle section 203 is positioned substantially between and integrally formed with the first side section 201 and the second side section 202. The middle section 203 is curved, e.g., downward. The first side section 201 is substantially parallel to the second side section 202 along the length of both side sections. The first side section 301, along its length, may be substantially straight. The second side section 302, along its length, may be substantially straight. In this direction, the middle section 203 does not extend beyond the length of the first side section 201 or the length of the second side section 202. The support assembly 210 has an upper side and an underside. The upper side of the support assembly 210 is formed of the upper side of the first side section 201, that of the second side section 202, and that of the middle section 203. The underside of the support assembly 210 is formed of the underside of the first side section 201, that of the second side section 202, and that of the middle section 203. As illustrated, on the upper side of each of the first side section 201, the second side section 202, and the middle section 203, there are patches 204, 205 and 206 of reusable hook-and-loop fasteners. Any one of the patches 204, 205 and 206 may fasten or bind temporarily with a complimentary patch of the reusable hook-and-loop fastener during the time that they are pressed together. The patch and the complimentary patch may be separated by peeling them apart. It is understood that the support assembly 210 may include more or fewer patches on either one of the first side section 201, the second side section 202, and the middle section 203.

The adjustment assembly includes a first adjustment subassembly and a second adjustment subassembly. The first adjustment subassembly includes a first linker 213 and a second linker 214. The second adjustment subassembly includes a first linker 215 and a second linker 216 (invisible in FIG. 2A). The first adjustment subassembly and the second adjustment subassembly are coupled to the support assembly 210 on the underside of the first side section 201 and the underside of the second side section 202. The first adjustment subassembly and the second adjustment subassembly are configured to cooperate to adjust the positioning of the support assembly 210 relative to another portion of the cradle frame, e.g., the beam connector of the connection assembly (discussed below). The relative positioning of the support assembly 210 includes, e.g., the height of the support assembly 210, the distance, the tilting angle of the support assembly 210, or the like.

The connection assembly includes a first beam 211 (see FIGS. 2B-2D), and a second beam 212, and a beam connector including a shaft sleeve 218 (described below in connection with FIG. 4C). The gear assembly may control, e.g., lock or unlock, the relative positioning of the support assembly 210 of the cradle frame (e.g., the table 100 shown in FIG. 1). Part of the gear assembly, a latch 220, is shown in FIG. 2A. The latch 220 may move in the directions as indicated by 230, between an unlocked position 220A as illustrated in phantom and a locked position 220B. When the latch 220 is in the unlocked position 220A, the gear assembly allows for the movements of the first linkers 213 and 215, the second linkers 214 and 216 of the adjustment assembly, and the first beam 211 and the second beam 212 of the connection assembly; while when the latch 220 is in the locked position 220B, the gear assembly prevents the movements of these parts. As illustrated in FIG. 2A, the first linker 213 and the second linker 214 of the first adjustment subassembly substantially align with each other; likewise, the first linker 215 and the second linker 216 of the second adjustment subassembly substantially align with each other. The second linker 214 of the first adjustment subassembly pivotally connected with the first side section 201 of the support assembly 210 at a protrusion 223. The protrusion 223 may be integrally formed with and on the underside of the first side section 201. The first linker 213 of the first adjustment subassembly includes a slot 213A through which the first linker 213 is rotatably and slidably coupled to the beam connector of the connection assembly. The first linker 213 may rotate around the beam connector and slide along the slot 213A. Likewise, the first linker 215 of the second adjustment subassembly includes a slot 215A through which the first linker 215 is rotatably and slidably coupled to the beam connector of the connection assembly. The first linker 215 may rotate around the beam connector and slide along the slot 215A.

As used herein, a first structural component being coupled or connected to/with a second structural component is used interchangeably. Both indicate that the movement of the first structural component and that of the second structural component are coordinated. The specific coordination depends on the specific coupling or connection between the first structural component and the second structural component.

FIG. 2B shows the exemplary cradle frame in a lower position with the beams 211 and 212 of the connection assembly in an unfolded configuration. As illustrated, the beams 211 and 212 are extended for coupling the cradle frame to a structure, e.g., the table 100 shown in FIG. 1. In this lower (or unraised) position, the first linker 213 and the second linker 214 of the first adjustment subassembly substantially align with each other; likewise, the first linker 215 and the second linker 216 of the second adjustment subassembly substantially align with each other. The first beam 211 and the second beam 212 of the connection assembly are substantially parallel to each other. The first beam 211 and the second beam 212 as illustrated are substantially straight. It is understood that in other embodiments, one or both of the first beam 211 and the second beam 212 may be curved.

FIGS. 2C and 2D show the exemplary cradle frame in a higher position with the beams 211 and 212 of the connection assembly in an unfolded configuration. As illustrated, the beams 211 and 212 are extended for coupling the cradle frame to a structure, e.g., the table 100 shown in FIG. 1. In this higher (or raised) position, the first linker 213 and the second linker 214 of the first adjustment subassembly do not align with each other; likewise, the first linker 215 and the second linker 216 of the second adjustment subassembly do not align with each other. The beam connector including the shaft sleeve 218 is located below or underneath the support assembly. FIG. 2C shows that the first linker 213 of the first adjustment subassembly is pivotally connected, at an end 213B of the first linker 213, with the first side section 201.

The cushion 250 shown in FIG. 2D may be put on the upper side of the support assembly 210. The cushion 250 may include one or more complimentary patches of reusable hook-and-loop fasteners that may fasten or bind temporarily with the patches 204, 205, and 206 on the upper side of the first side section 201, the upper side of the second side section 202, the upper side of the middle section 203, respectively, during the time that the one or more complimentary patches on the cushion and the patches on the support assembly 210 are pressed together. The patches and the complimentary patches may be separated by, e.g., peeling them apart.

Figure 3A:
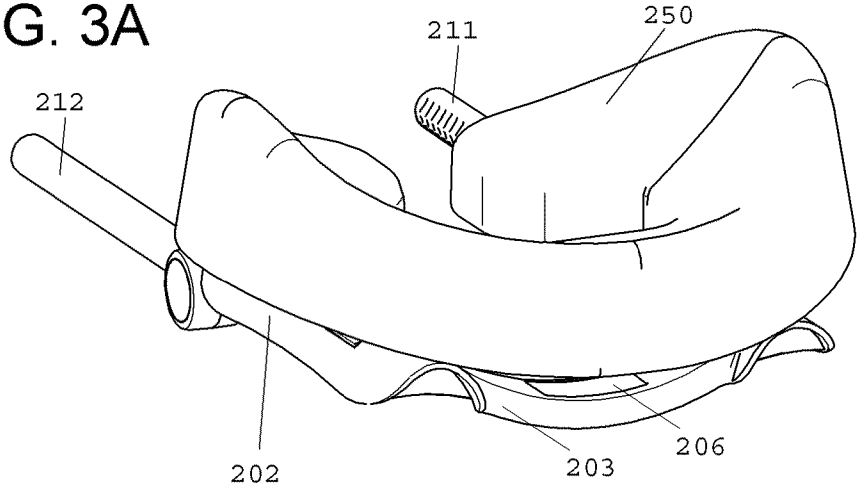
FIG. 3A illustrates a perspective view of an exemplary cradle frame and a cushion when there is no force applied to the cushion according to some embodiments of the present teachings.
Figure 3B:
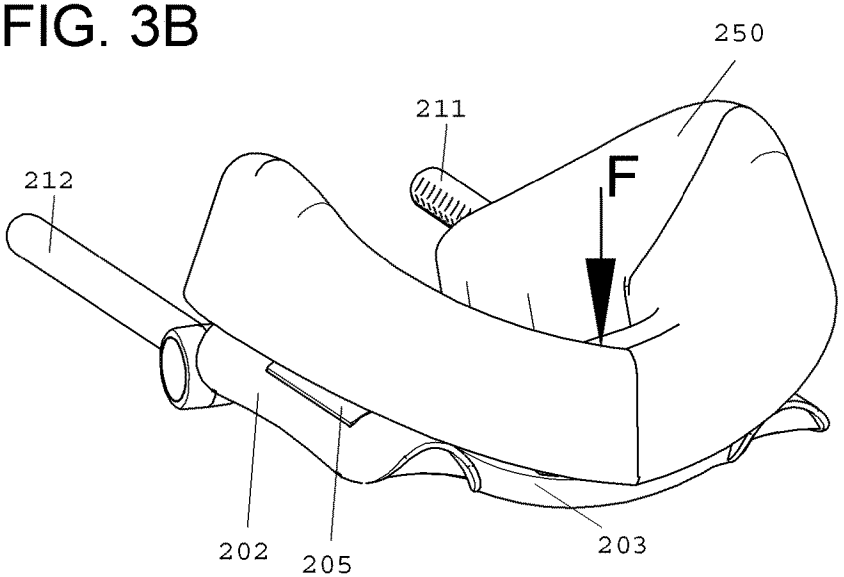
FIG. 3B illustrates a perspective view of an exemplary cradle frame and a cushion when a force is applied to the cushion according to some embodiments of the present teachings.

FIG. 3A and FIG. 3B illustrate perspective views of the exemplary cradle frame and the cushion 250 when there is no force applied to the cushion 250 (FIG. 3A) and when a force F is applied to the cushion 250 (FIG. 3B). In both FIG. 3A and FIG. 3B, the exemplary cradle frame is in a lower position with the beams 211 and 212 of the connection assembly in an unfolded configuration, extended for coupling the cradle frame to a structure, e.g., the table 100 shown in FIG. 1. As shown in FIG. 3A, when there is no force applied to the cushion 250, two arms of the cushion 250 temporarily bind, via the complimentary patches of reusable hook-and-loop fasteners on the two arms of the cushion 250 (invisible in FIG. 3A), to the support assembly 210, via the patches 204 and 205 on the upper side of the first side section 201 and the upper side of the second side section 202, respectively. The middle part of the cushion 250 does not bind to the middle section 203 of the support assembly 210 where the middle section 203 is curved, e.g., downward. As shown in FIG. 3B, when the force F is applied to the cushion 250, the two arms of the cushion 250 that originally bind to the first side section 201 and the second side section 202 of the support assembly 210 (as shown in FIG. 3A) deflect, e.g., upward and inward, and partially separate the binding between the two arms of the cushion 250 and the first side section 201 and the second side section 202 of the support assembly 210. The force F pushes the middle part of the cushion 250 downward such that it binds temporarily, via the complimentary patch of a reusable hook-and-loop fastener on the middle part of the cushion 250 (invisible in FIG. 3B), to the middle section 203 of the support assembly 210, via the patch 206 on the upper side of the middle section 203. The downward curve of the middle section 203 may facilitate the middle part of the cushion 250 to move downward when the force F is applied.

Figure 4B:
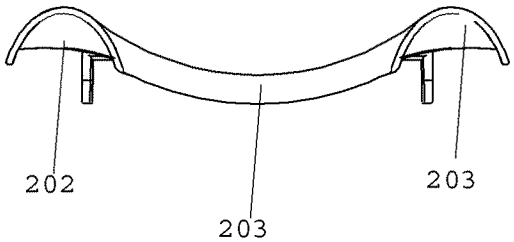
FIG. 4B shows a front view of the support assembly 210 of the support assembly illustrated in FIG. 4A according to some embodiments of the present teachings.
Figure 4A:
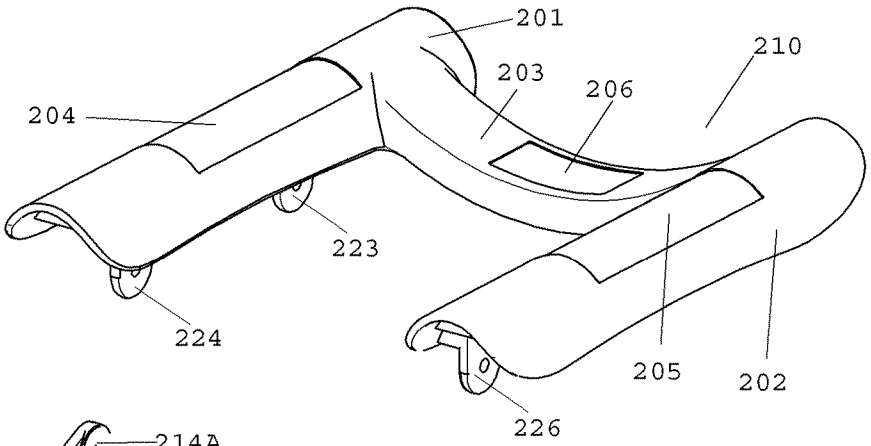
FIG. 4A shows a perspective view of the support assembly according to some embodiments of the present teachings.

FIG. 4A shows a perspective view of the support assembly 210. The support assembly 210 includes the first side section 201, the second side section 202, and the middle section 203. The patch 204 of a reusable hook-and-loop fastener is located on the upper side of the first side section 201. Likewise, the patch 205 of a reusable hook-and-loop fastener is located on the upper side of the second side section 202, and the patch 206 of a reusable hook-and-loop fastener is located on the upper side of the middle section 203. Also shown in this figure includes protrusions 223 and 224 on the underside of the first side section 201 of the support assembly 210, and a protrusion 226 on the underside of the second side section 202 of the support assembly 210. The protrusion 223 is where the second linker 214 of the first adjustment subassembly is pivotally connected to the first side section 201 of the support assembly 210. The protrusion 224 is where the first linker 213 of the first adjustment subassembly is pivotally connected to the first side section 201 of the support assembly 210. The protrusion 226 is where the first linker 215 of the second adjustment subassembly is pivotally connected to the second side section 202 of the support assembly 210. Although not shown in FIG. 4A, there may be a protrusion on the underside of the second side section 202 where the second linker 216 of the second adjustment subassembly is pivotally connected to the second side section 202 of the support assembly 210. At least one of the protrusions may be integrally formed with the first side section 201 or the second side section 202 of the support assembly 210. FIG. 4B shows a front view of the support assembly 210.

Figure 4C:
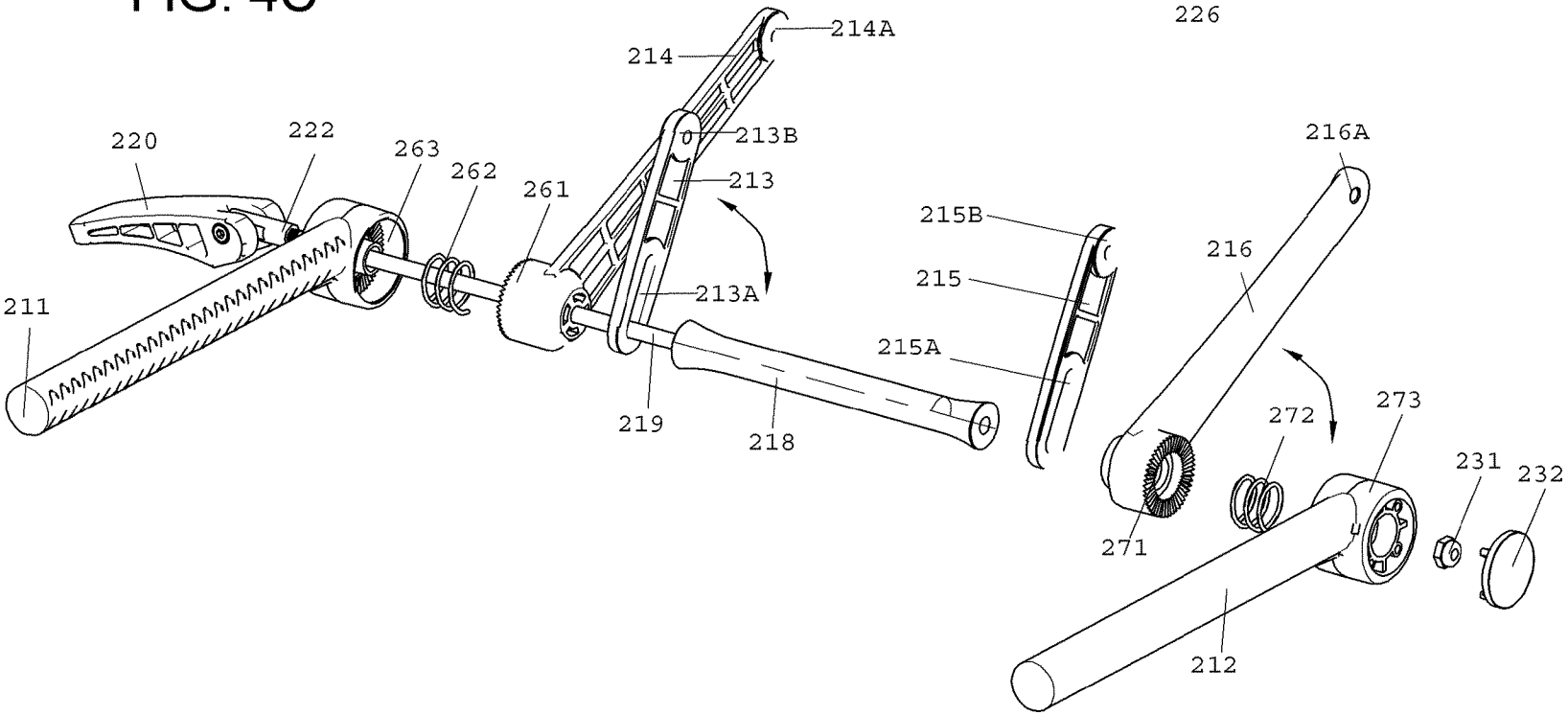
FIG. 4C is an exploded view of the adjustment assembly, the connection assembly, and the gear assembly according to some embodiments of the present teachings.

FIG. 4C is an exploded view of the adjustment assembly, the connection assembly, and the gear assembly. The adjustment assembly includes the first adjustment subassembly and the second adjustment subassembly. The first adjustment subassembly includes the first linker 213 and the second linker 214. The first linker 213 of the first adjustment subassembly is configured to be rotatably and slidably coupled, through the slot 213A, to the beam connector of the connection assembly; the first linker 213 is configured to be pivotally connected, at 213B, to the protrusion 224 on the underside of the first side section 201 of the support assembly 210. The second linker 214 is configured to be pivotally connected, at 214A, to the protrusion 223 on the underside of the first side section 201 of the support assembly 210. The second linker 214 is configured to be pivotally connected on the other end to the beam connector. The configuration of the first linker 215 of the second adjustment subassembly is symmetric to that of the first linker 213 of the first adjustment subassembly, and the configuration of the second linker 216 of the second adjustment subassembly is symmetric to that of the second linker 214 of the first adjustment subassembly.

The connection assembly includes the first beam 211, the second beam 212, and the beam connector. The beam connector includes a shaft sleeve 218 and a double end threaded stud 219.

The gear assembly includes the latch 220, an internal thread connector 222, large crown gears 263 and 273, springs 262 and 272, small crown gears 261 and 271, a self-locking nut 231, and a cap 232. The small crown gear 261 is integrally formed with the second linker 214 of the first adjustment subassembly. Likewise, the small crown gear 271 is integrally formed with the second linker 215 of the second adjustment subassembly. The large crown gear 263 is integrally formed with the first beam 211; likewise, the large crown gear 273 is integrally formed with the second beam 212.

FIGS. 5A-9C illustrate another exemplary cradle frame having features of the present teachings. A cushion is shown in some of these figures as well. The exemplary cradle frames illustrated in FIGS. 5A-9C are essentially symmetric except that the latch 320 is located closer to the first side section 301 of the support assembly 310 than to the second side section 302 of the support assembly 310. It is understood that it is not intended to limit the scope of the application.

Figure 5A:
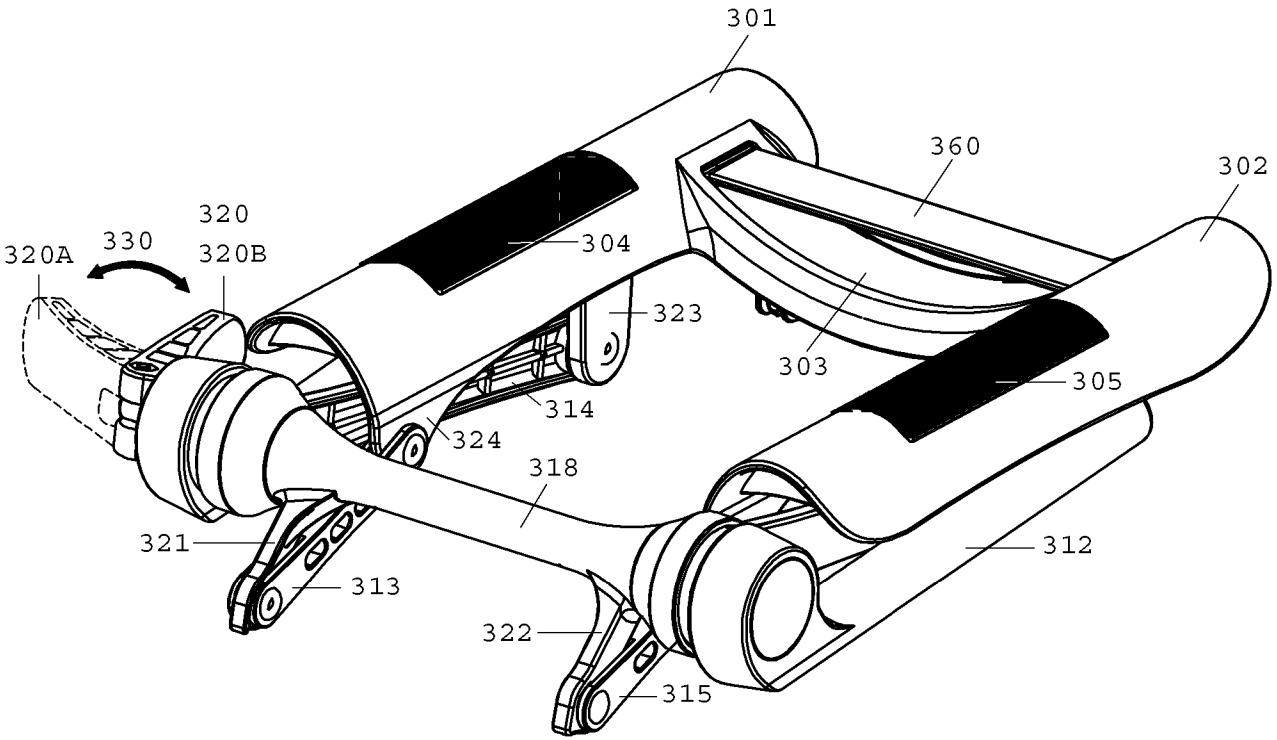
FIG. 5A shows an exemplary cradle frame with the beams of the connection assembly in a folded configuration according to some embodiments of the present teachings.
Figure 5B:
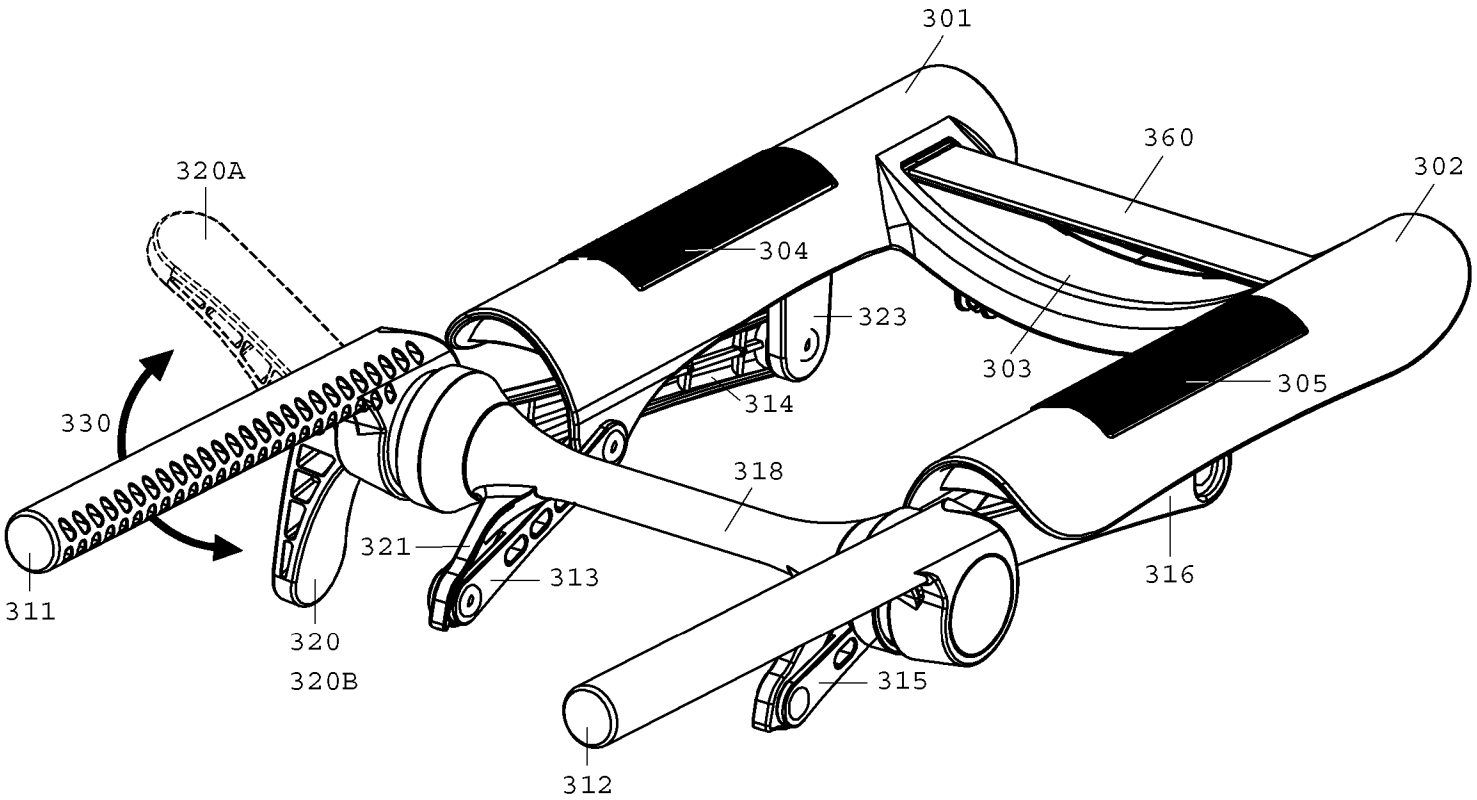
FIG. 5B shows an exemplary cradle frame with the beams of the connection assembly in an unfolded configuration according to some embodiments of the present teachings.
Figure 5C:
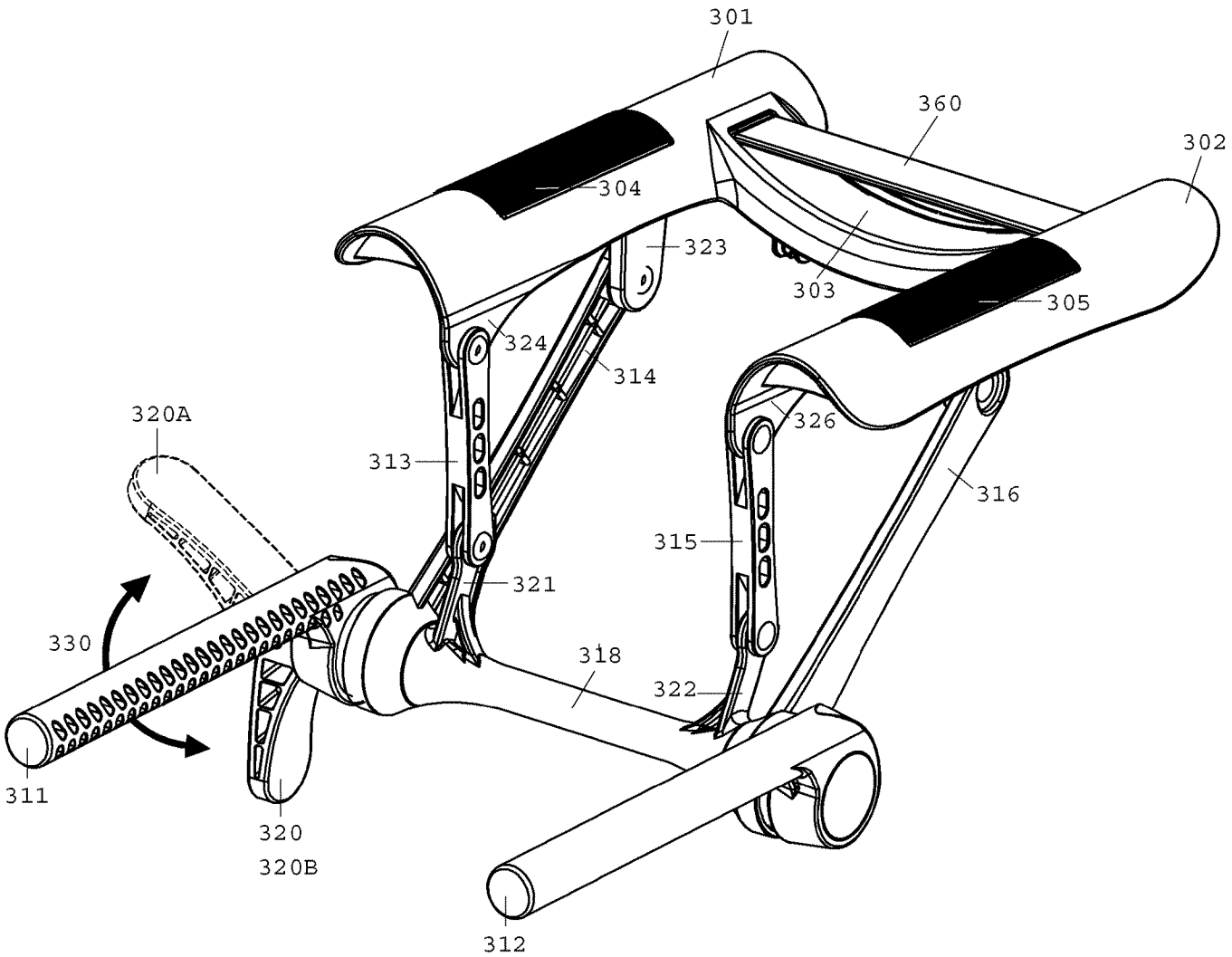
FIGS. 5C-5E show an exemplary cradle frame in a raised position with the beams of the connection assembly in an unfolded configuration according to some embodiments of the present teachings.
Figure 5D:
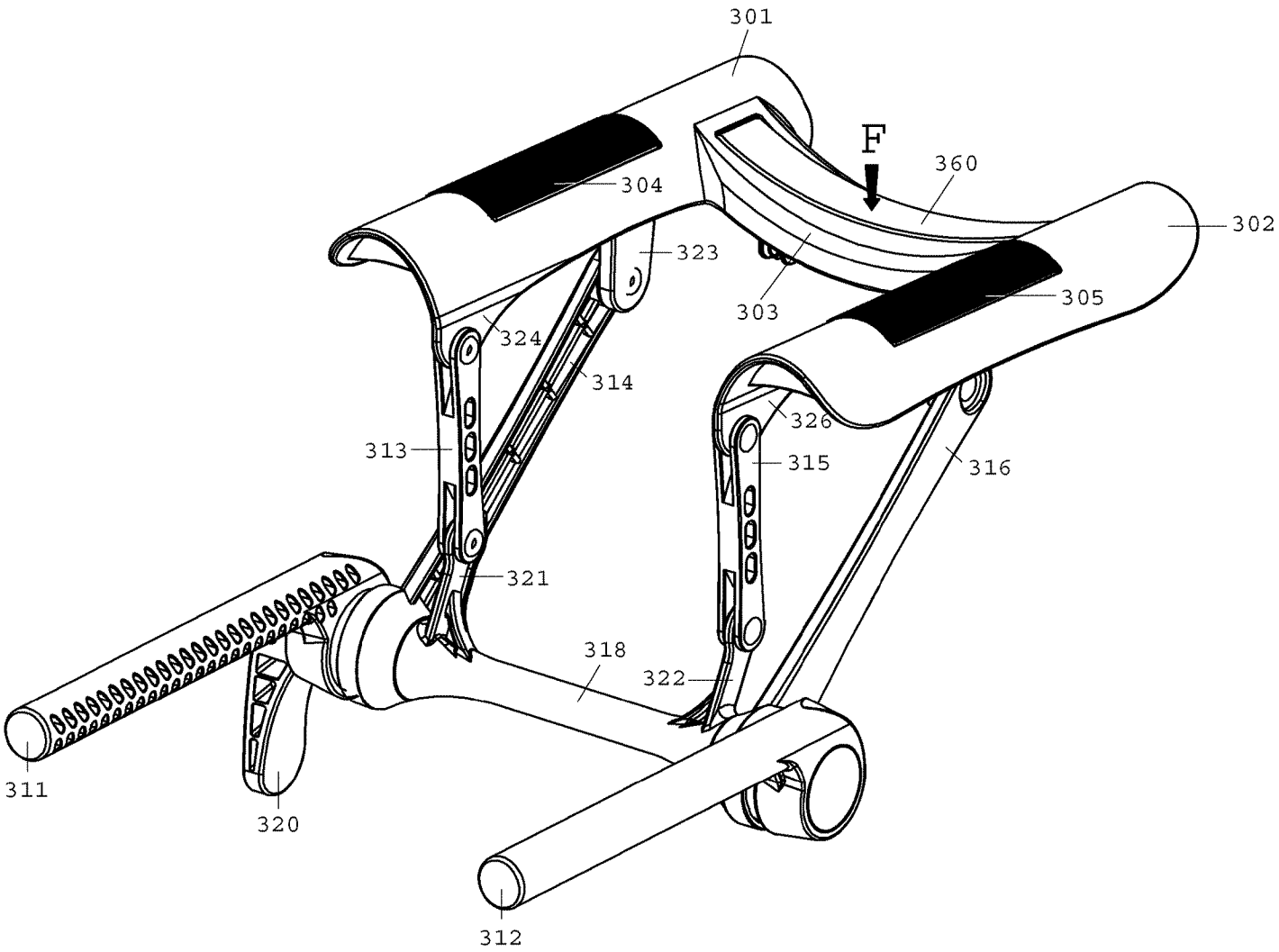
Figure 5E:
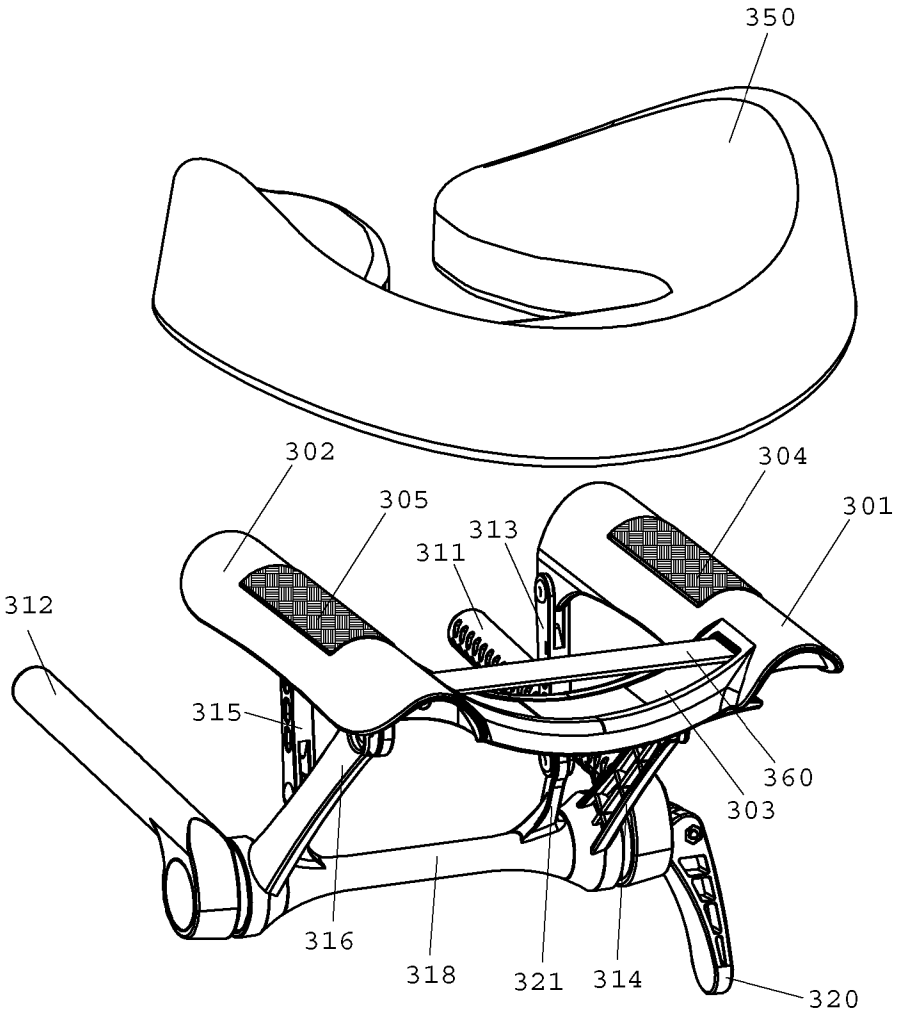

FIGS. 5A-5E illustrate perspective views of the exemplary cradle frame. As illustrated, the exemplary cradle frame includes the support assembly 310 (see FIG. 7), an adjustment assembly, a gear assembly, and a connection assembly. FIG. 5A shows the exemplary cradle frame with the beams 311 and 312 of the connection assembly in a folded configuration for, e.g., storage and/or transportation purposes. FIG. 5B shows the exemplary cradle frame in a lower (or unraised) position with the beams 311 and 312 of the connection assembly in an unfolded configuration, extended for coupling the cradle frame to a structure, e.g., the table 100 shown in FIG. 1. FIGS. 5C-5E show the exemplary cradle frame in a higher (or raised) position with the beams 311 and 312 of the connection assembly in an unfolded configuration, extended for coupling the cradle frame to a structure, e.g., the table 100 shown in FIG. 1. FIG. 5E also shows a cushion 350 that may be used with the cradle frame. At least one of the support assembly 310, an adjustment assembly, a gear assembly, and a connection assembly, or components of any one of these assemblies may be made of a rigid material. Merely by way of example, the first side section 301, the second side section 302, and the middle section 303 of the support assembly 310 may be an integral piece made of, e.g., plastic, wood, metal, or the like. Plastic may include, e.g., nylon (e.g., PA6), or at least one of other types of polymers.

FIG. 5A shows the exemplary cradle frame with the beams 311 and 312 of the connection assembly in a folded configuration for, e.g., storage and/or transportation purposes. As shown in the figure, the support assembly 310 includes a first side section 301, a second side section 302, and a middle section 303. The middle section 303 is positioned substantially between and integrally formed with the first side section 301 and the second side section 302. The middle section 303 is curved, e.g., downward. The first side section 301 is substantially parallel to the second side section 302 along the length of both side sections. The first side section 301, along its length, may be substantially straight. The second side section 302, along its length, may be substantially straight. In this direction, the middle section 303 does not extend beyond the length of the first side section 301 or the length of the second side section 302. The support assembly 310 has an upper side and an underside. The upper side of the support assembly 310 is formed of the upper side of the first side section 301, that of the second side section 302, and that of the middle section 303. The underside of the support assembly 310 is formed of the underside of the first side section 301, that of the second side section 302, and that of the middle section 303. As illustrated, on the upper side of each of the first side section 301 and the second side section 302, there are patches 304 and 305 of reusable hook-and-loop fasteners. Although not shown in FIG. 5A, the middle section 303 may also include a patch of a reusable hook-and-loop fastener. Any one of the patches may fasten or bind temporarily with a complimentary patch of the reusable hook-and-loop fastener during the time that they are pressed together. The patch and the complimentary patch may be separated by, e.g., peeling them apart. It is understood that the support assembly 310 may include more or fewer patches on either one of the first side section 301, the second side section 302, and the middle section 303.

As shown in FIG. 5A, the support assembly 310 also includes a ribbon 360, a portion of which is located substantially between the first side section 301 and the second side section 302, and substantially above the upper side of the middle section 303. As discussed later in connection with FIGS. 9A-9C, the length of the portion of the ribbon 360 substantially above the upper side of the middle section 303 may be adjusted.

The adjustment assembly includes a first adjustment subassembly and a second adjustment subassembly. The first adjustment subassembly includes a first linker 313, a second linker 314, and a third linker 321. The second adjustment subassembly includes a first linker 315, a second linker 316 (invisible in FIG. 5A), and a third linker 322. The first adjustment subassembly and the second adjustment subassembly are coupled to the support assembly 310 on the underside of the first side section 301 and the underside of the second side section 302. The first adjustment subassembly and the second adjustment subassembly are configured to cooperate to adjust the positioning of the support assembly relative to another portion of the cradle frame, e.g., the beam connector. The relative positioning of the support assembly 310 includes, e.g., the height of the support assembly 310, the distance, the tilting angle of the support assembly 310, or the like.

The connection assembly includes a first beam 311 (see FIGS. 5B-5E), and a second beam 312, and a beam connector including a shaft sleeve 318 (described below in connection with FIG. 7). The gear assembly may control (e.g., lock or unlock) the positioning of the support assembly 310 relative to the beam connector of the cradle frame. Part of the gear assembly, a latch 320, is shown in FIG. 5A. The latch 320 may move in the directions as indicated by 330, between an unlocked position 320A as illustrated in phantom and a locked position 320B. When the latch 320 is in the unlocked position 320A, the gear assembly allows for the movements of the second linkers 314 and 316, the third linkers 321 and 322 of the adjustment assembly, and the first beam 311 and the second beam 312 of the connection assembly; while when the latch 320 is in the locked position 320B, the gear assembly prevents the movements of these parts. As illustrated in FIG. 5A, the first linker 313, the second linker 314, and the third linker 321 of the first adjustment subassembly substantially align with each other; likewise, the first linker 315, the second linker 316, and the third linker 322 of the second adjustment subassembly substantially align with each other.

FIG. 5B shows the exemplary cradle frame in a lower (or unraised) position with the beams 311 and 312 of the connection assembly in an unfolded configuration, extended for coupling the cradle frame to a structure, e.g., the table 100 shown in FIG. 1. In this lower position, the first linker 313, the second linker 314, and the third linker 321 of the first adjustment subassembly substantially align with each other; likewise, the first linker 315, the second linker 316, and the third linker 322 of the second adjustment subassembly substantially align with each other. The first beam 311 and the second beam 312 of the connection assembly are substantially parallel to each other. The first beam 311 and the second beam 312 as illustrated are substantially straight. It is understood that in other embodiments, one or both of the first beam 311 and the second beam 312 may be curved.

FIGS. 5C-5E show the exemplary cradle frame in a higher (or raised) position with the beams 311 and 312 of the connection assembly in an unfolded configuration, extended for coupling the cradle frame cushion to a structure, e.g., the table 100 shown in FIG. 1. In this higher position, the first linker 313, the second linker 314, and the third linker 321 of the first adjustment subassembly do not align with each other; likewise, the first linker 315, the second linker 316, and the third linker 322 of the second adjustment subassembly do not align with each other. The beam connector including the shaft sleeve 318 is located below or underneath the support assembly 310. FIG. 5C shows that the second linker 314 of the first adjustment is pivotally connected with the first side section 301 of the support assembly 310 at a protrusion 323. The protrusion 323 may be integrally formed with and on the underside of the first side section 301. The first linker 313 of the first adjustment subassembly is pivotally connected, on one end, with the first side section 301 of the support assembly 310 at a protrusion 324, and is pivotally connected, on the other end, with the third linker 321. The protrusion 324 may be integrally formed with and on the underside of the first side section 301. Likewise, the first linker 315 of the second adjustment subassembly is pivotally connected, on one end, with the second side section 302 of the support assembly 310 at a protrusion 326, and is pivotally connected, on the other end, with the third linker 322. FIG. 5D shows that the latch 320 is at its locked position 320B. The second linker 316 of the second adjustment subassembly is pivotally connected, on one end, with the second side section 302 of the support assembly 310 at a protrusion 325 (see FIGS. 7 and 8). The protrusion 325 may be integrally formed with and on the underside of the second side section 302. Moreover, FIG. 5D shows that when a force F is applied to the ribbon 360, the ribbon may deflect along the direction of the force F.

The cushion 350 shown in FIG. 5E may be put on the upper side of the support assembly 310. The cushion 350 may include one or more complimentary patches of reusable hook-and-loop fasteners that may fasten or bind temporarily with the patches 304 and 305 on the upper side of the first side section 301 and the upper side of the second side section 302, respectively, during the time that the one or more complimentary patches on the cushion and the patches on the support assembly 310 are pressed together. The patches and the complimentary patches may be separated by peeling them apart.

Figure 6A:
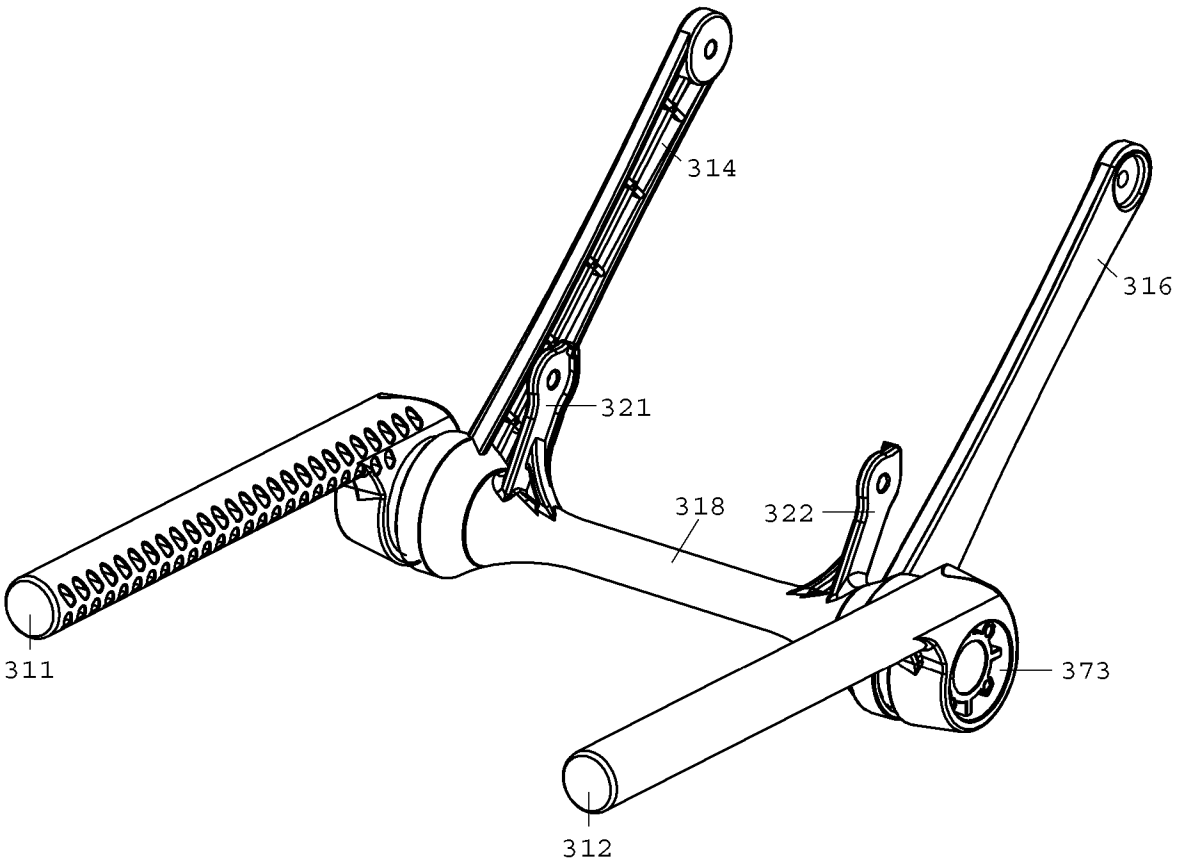
FIGS. 6A and 6B provide views of a portion of the adjustment assembly, the connection assembly, and the gear assembly according to some embodiments of the present teachings.
Figure 6B:
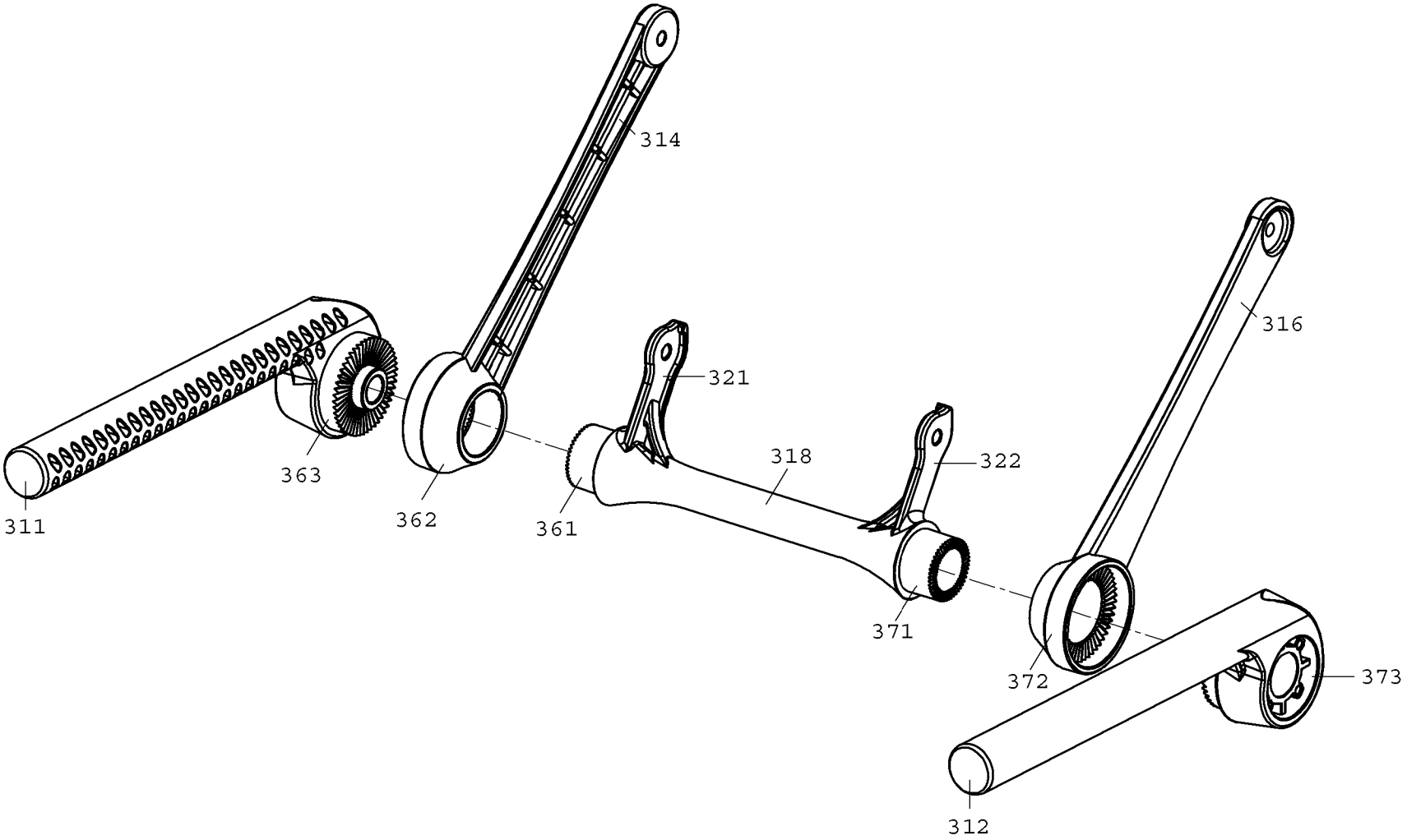

FIGS. 6A and 6B provide views of a portion of the adjustment assembly, the connection assembly, and the gear assembly. The adjustment assembly includes a first adjustment subassembly and a second adjustment subassembly. Shown in these figures include the second linker 314 and the third linker 321 of the first adjustment subassembly, the second linker 316 and the third linker 322 of the second adjustment subassembly, the first beam 311, the second beam 312, and the shaft sleeve 318 of the connection assembly. Also shown in FIG. 6B are small crown gears 363 and 373, large crown gears 362 and 372, and the shaft sleeve 318 with a small crown gear 361 on one end and a small crown gear 371 on the other end. The third linkers 321 and 322 are also located on the shaft sleeve 318.

Figure 7:
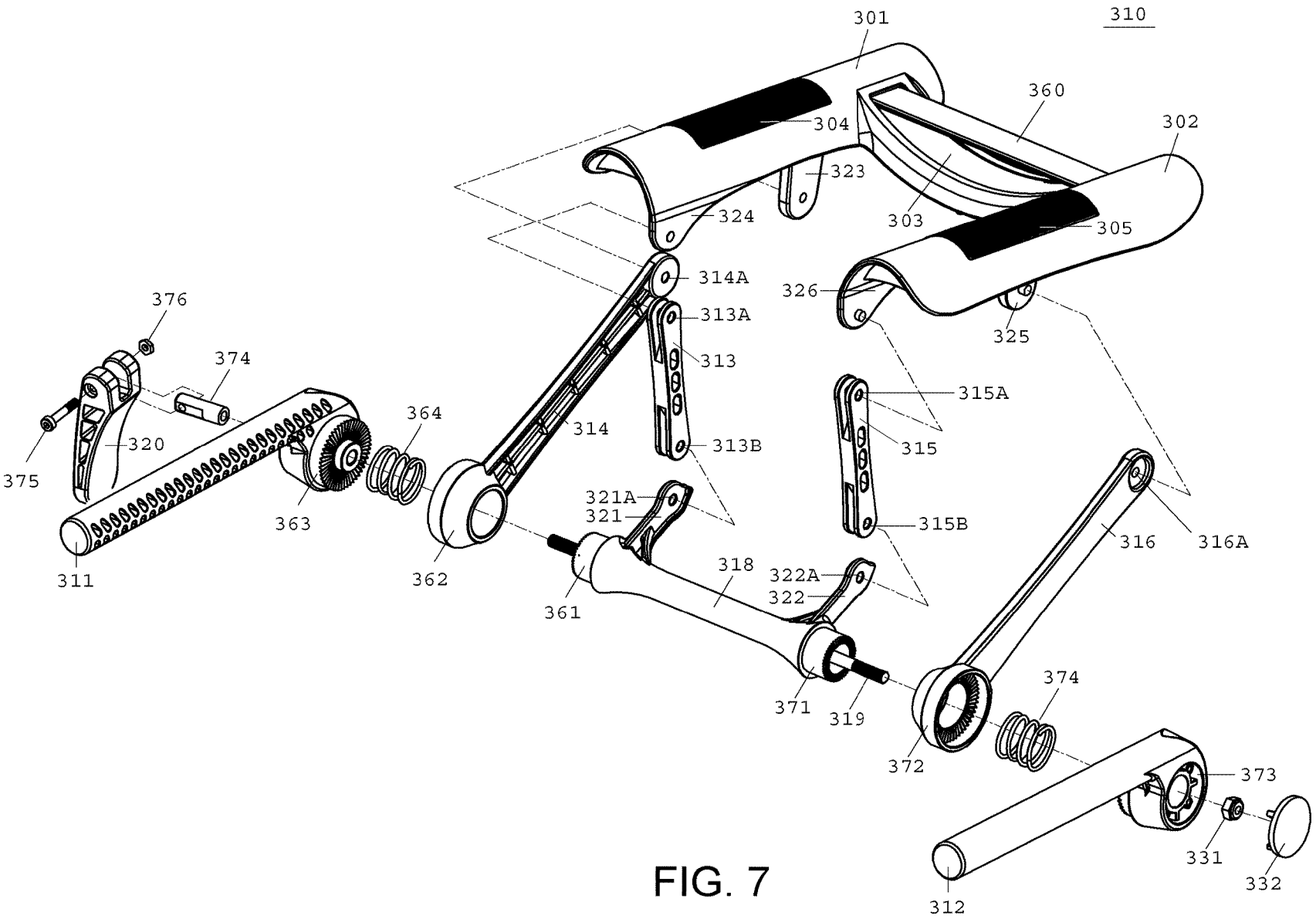
FIG. 7 is an exploded view of the support assembly, the adjustment assembly, the connection assembly, and the gear assembly according to some embodiments of the present teachings.

FIG. 7 is an exploded view of an exemplary cradle frame. The cradle frame includes the support assembly, the adjustment assembly, the connection assembly, and the gear assembly. The adjustment assembly includes the first adjustment subassembly and the second adjustment subassembly. The first adjustment subassembly includes the first linker 313, the second linker 314, and the third linker 321. The first linker 313 of the first adjustment subassembly is configured to be pivotally connected, at 313A, to the underside of the first side section 301 at the protrusion 324, and pivotally connected, at 313B, to the third linker 321 at 321A. The second linker 314 is configured to be pivotally connected, at 314A, to the protrusion 323 on the underside of the first side section 301 of the support assembly 310. The second linker 314 is configured to be pivotally connected, on the other end, to the beam connector. The third linker 321 is located on the shaft sleeve 318. The configuration of the first linker 315 of the second adjustment subassembly is symmetric to that of the first linker 313, the second linker 316 of the second adjustment subassembly is symmetric to that of the second linker 314 of the first adjustment subassembly, and the third linker 322 of the second adjustment subassembly is symmetric to that of the third linker 321 of the first adjustment subassembly.

The connection assembly includes the first beam 311, the second beam 312, and the beam connector. The beam connector includes a shaft sleeve 318 and a double end threaded stud 319.

The gear assembly includes the latch 320, a bolt 375, a nut 376, an internal thread connector 374, small crown gears 361, 363, 371, and 373, springs 364 and 374, large crown gears 262 and 272, a self-locking nut 331, and a cap 332. The large crown gear 362 is integrally formed with the second linker 314 of the first adjustment subassembly. Likewise, the large crown gear 372 is integrally formed with the second linker 315 of the second adjustment subassembly. The small crown gears 361 and 371 are integrally formed with the shaft sleeve 318 of the connection assembly. The small crown gear 363 is integrally formed with the first beam 311 of the connection assembly. Likewise, the small crown gear 373 is integrally formed with the second beam 312 of the connection assembly.

Figure 8:
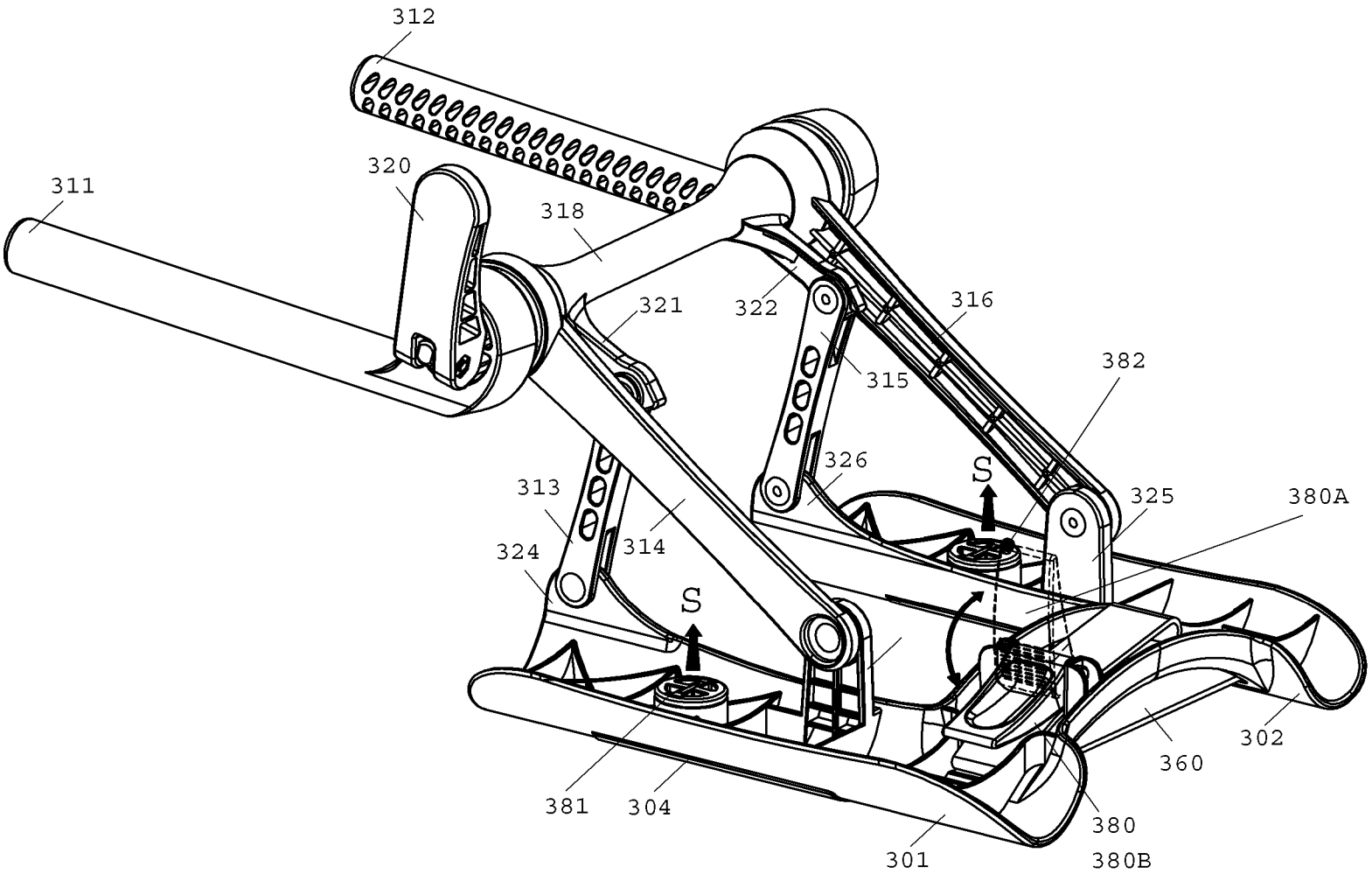
FIG. 8 is a perspective view of the underside of the support assembly, the adjustment assembly, the connection assembly, and the gear assembly according to some embodiments of the present teachings.

FIG. 8 is a perspective view of the underside of the support assembly, the adjustment assembly, the connection assembly, and the gear assembly. On the underside of the first side section 301, there is a cavity with a round cap 381. Likewise, on the underside of the second side section 302, there is a cavity with a round cap 382. The arrows S indicate the direction the round caps 381 and 382 may be removed. The cavity is configured to hold an agent including, e.g., at least one composition selected from the group consisting of a fragrance, an essential oil, and a medication, or the like. The cavity may house a wicking material, and the wicking material is configured to absorb and/or release the agent. It is understood that although the cavity and the associated structural components are described in connection with the exemplary support assembly illustrated in FIGS. 5A-9C, it may also be incorporated in the exemplary support assembly illustrated in FIGS. 2A-4C or other embodiments.

As shown in FIG. 8, a buckle 380 located on the underside of the middle section 303 is configured to adjust the length of the portion of the ribbon 360 above (i.e. on the upper side rather than the underside of) the middle section 303 of the support assembly 310. When the buckle 380 is at its unlocked position 380A illustrated in phantom, the length of the portion of the ribbon 360 above the middle section 303 may be adjusted. When the buckle 380 is at its locked position 380B, the length of the portion of the ribbon 360 above the middle section 303 may be locked. However, depending on the magnitude of the force applied onto the portion of the ribbon 360, the ribbon 360 may still deflect when the buckle 380 is at its locked position 380B.

Figure 9A:
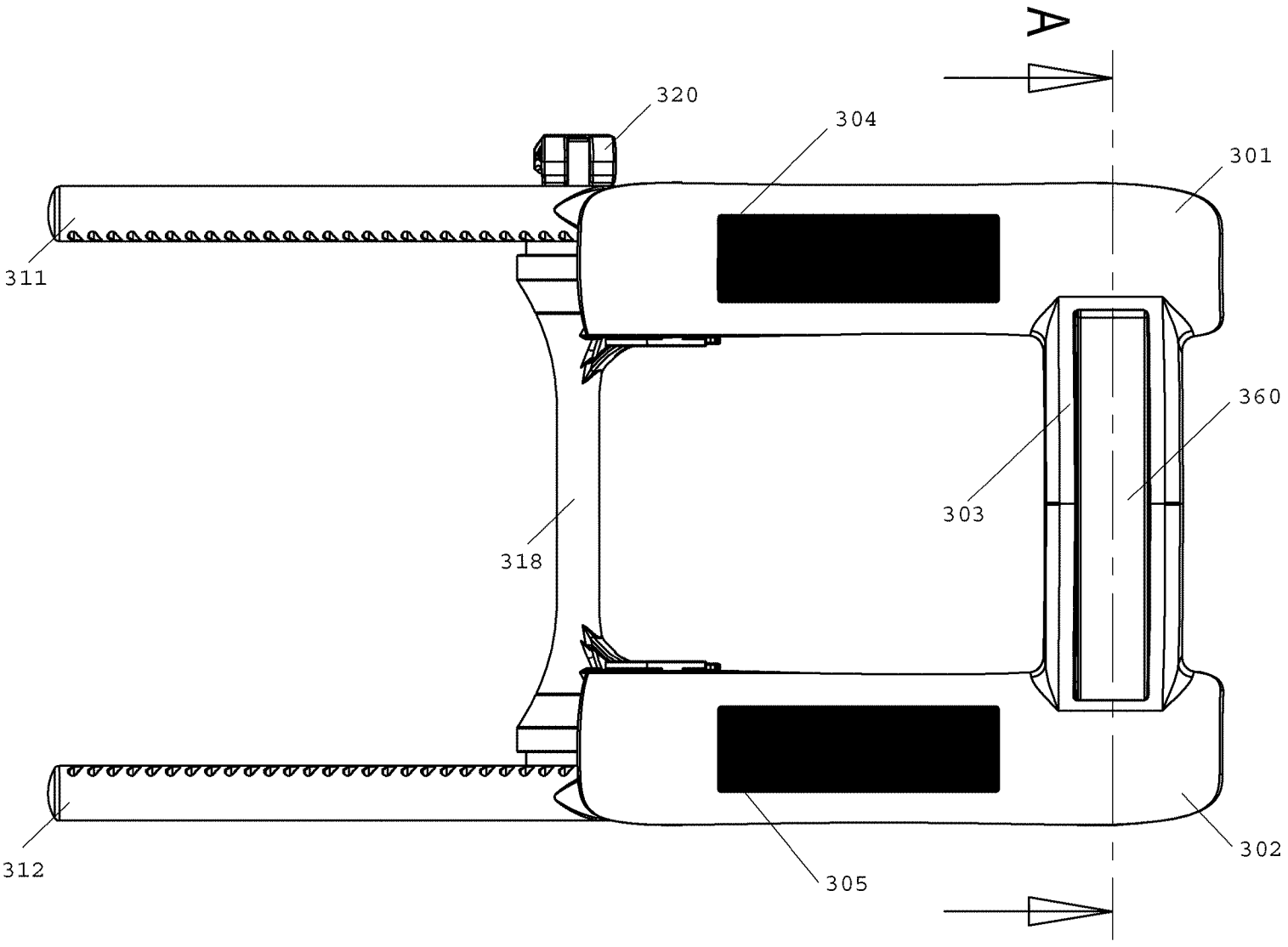
FIG. 9A is a top view (from above the upper side of the support assembly) of the support assembly, the adjustment assembly, the connection assembly, and the gear assembly according to some embodiments of the present teachings.
Figure 9B:
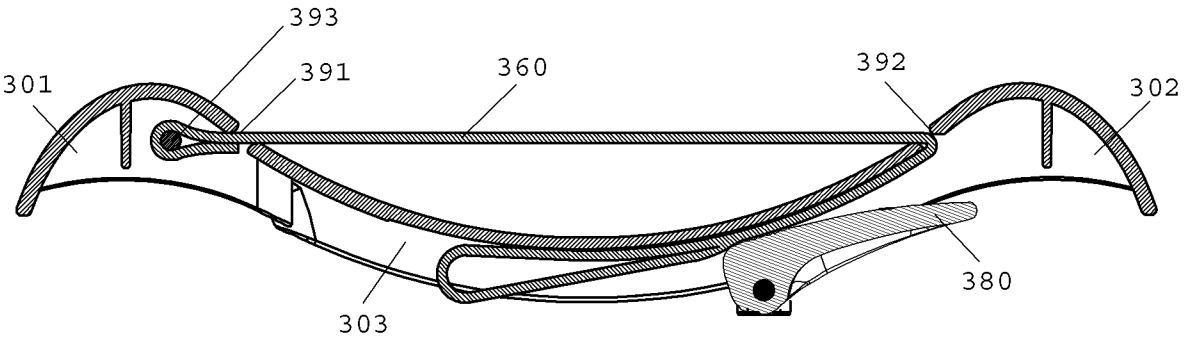
FIG. 9B is a view of the support assembly illustrated in FIG. 9A as viewed from a plane indicated as A-A when there is no force applied to the ribbon according to some embodiments of the present teachings.
Figure 9C:
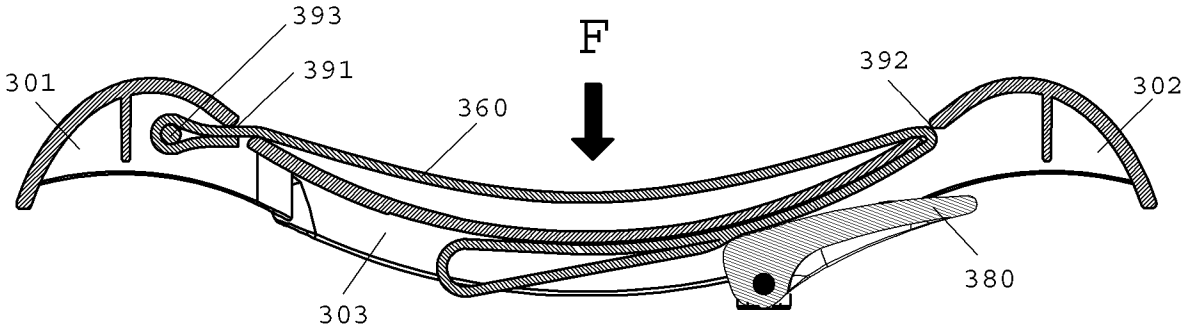
FIG. 9C is a view of the support assembly illustrated in FIG. 9A as viewed from a plane indicated as A-A when there is a force applied to the ribbon according to some embodiments of the present teachings.

FIGS. 9A-9C further illustrate the configuration of the ribbon 360. FIG. 9A is a top view (from above the upper side of the support assembly) of the support assembly, the adjustment assembly, the connection assembly, and the gear assembly. FIGS. 9B and 9C are the views of the support assembly illustrated in FIG. 9A as viewed from a plane indicated as A-A. FIG. 9B shows the ribbon 360 when there is no force applied to the ribbon 360. The ribbon 360 is fixed, on one end, by a pin 393 located on the underside of the first side section 301. The first side section 301 includes a slit 391 through which the ribbon 360 extends out of the underside of the first side section 301. The ribbon 360 extends substantially between the first side section 301 and the second side section 302 and is located substantially above the upper side of the middle section 303. The second side section 302 includes a slit 392 through which the ribbon 360 extends into the underside of the first side section 302, and pass through the buckle 380. FIG. 9B shows that when there is a force F applied to the ribbon 360, the ribbon 360 may deflect. It is understood that although the ribbon 360 and the associated structural components are described in connection with the exemplary support assembly illustrated in FIGS. 5A-9C, it may also be incorporated in the exemplary support assembly illustrated in FIGS. 2A-4C or other embodiments.

Some embodiments of the present teachings include a cradle frame. The cradle frame may include a connection assembly, a support assembly, an adjustment assembly, and a gear assembly.

The support assembly may include a first side section, a second side section, and a middle section. The first side section and the second side section are substantially parallel. The middle section is curved, e.g., downward, and positioned substantially between the first side section and the second side section. The middle section may be integrally formed with the first side section and the second side section. The first side section, along the length of the first side section, may be substantially parallel to the second side section, along the length of the second side section. The first side section, along the length of the first side section, may be substantially straight. The second side section, along the length of the second side section, may be substantially straight. In some embodiments, the middle section does not extend beyond the length of the first side section or the length of the second side section. The first side section, the second side section, and the middle section of the support assembly may be an integral piece made of, e.g., plastic, wood, metal, or the like. Plastic may include, e.g., nylon (e.g., PA6), or at least one of other types of polymers. The support assembly may also include a ribbon or band. A portion of the ribbon or band is located substantially between the first side section and the second side section and substantially above the middle section. The length of the portion of the ribbon or band is adjustable. The support assembly may include a cavity configured to hold an agent including, e.g., a fragrance, an essential oil, or a medication, or the like. The cavity may be covered by a cap that is configured to allow the agent to release. The cap may include one or more holes. The cap may be made of a material that is permeable to the agent.

The connection assembly is configured to couple the cradle frame to a structure. The connection assembly includes a first beam, a second beam, and a beam connector. The beam connector couples the first beam and the second beam. The adjustment assembly includes a first adjustment subassembly and a second adjustment subassembly. The first adjustment subassembly is coupled to the first side section of the support assembly, and the second adjustment subassembly is coupled to the second side section of the support assembly. The first adjustment subassembly and the second adjustment subassembly are configured to cooperate to adjust the positioning of the support assembly relative to another portion of the cradle frame, e.g., the beam connector. The relative positioning of the support assembly includes, e.g., the height of the support assembly, the distance, the tilting angle of the support assembly, or the like. The gear assembly is coupled to the adjustment assembly for controlling the relative positioning of the support assembly.

FIGS. 10A-15B illustrate an exemplary U-shape cushion 1. The exemplary U-shape cushion 1 may be used in connection with a cradle frame disclosed herein to form a cradle. The cradle may be coupled to a structure including, for example, a massage table, a massage chair, or a table/bed or chair for medical or other uses, or the like. The cushion may also be used independently as, for example, a neck pillow, or the like.

Figure 10A:
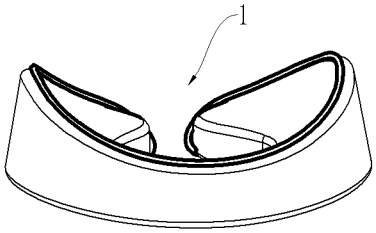
FIG. 10A and FIG. 10B show perspective views of an exemplary cushion according to some embodiments of the present teachings.
Figure 10B:
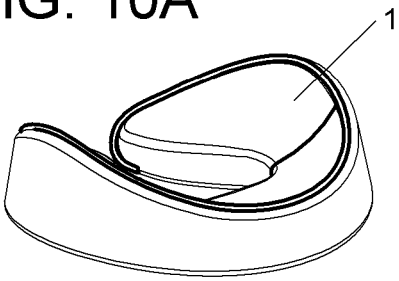
Figure 10C:
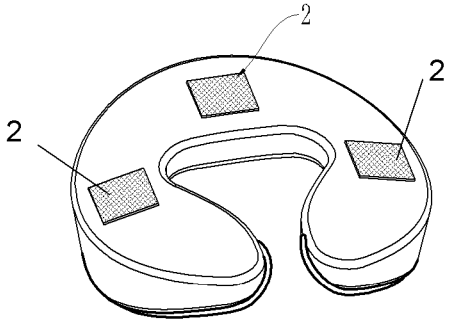
FIG. 10C shows a perspective view of the underside of the cushion illustrated in FIGS. 10A and 10B according to some embodiments of the present teachings.

FIG. 10A and FIG. 10B show perspective views of the exemplary cushion 1. FIG. 10C shows a perspective view of the underside of the cushion 1. There are three patches 2 of reusable hook-and-loop fasteners. These patches 2 may be complimentary to those on the support assembly 210 or the support assembly 310 of exemplary cradle frames already discussed, if the cushion 1 is intended to be used with any one of those exemplary cradle frames.

Figure 11A:
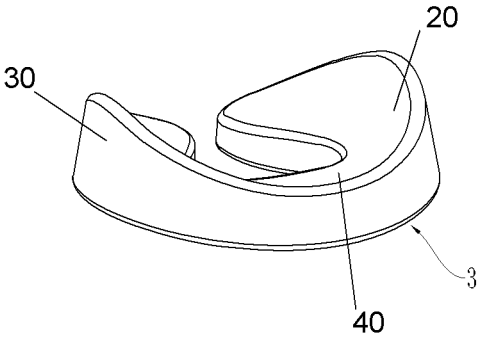
FIGS. 11A and 11B show the perspective views of the body of an exemplary cushion according to some embodiments of the present teachings.
Figure 11B:
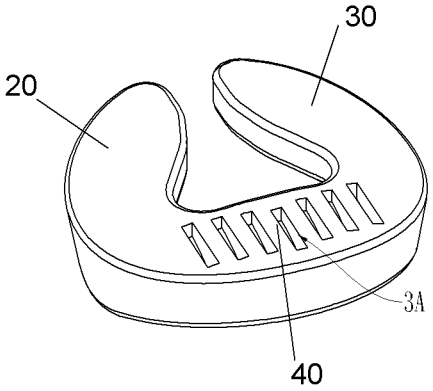

FIGS. 11A and 11B show the perspective views of the body 3 of the exemplary cushion 1. The body 3 includes a first arm 20, a second arm 30, and a middle part 40. The middle part 40 has a thickness, a length, and a width. The middle part 40, along the length thereof, is positioned substantially between and integrally formed with the first arm 20 and the second arm 30.

As shown in FIG. 11A, on the upper side of the body 3, the first arm 20, the second arm 30, and the middle part 40 may form a contour for better matching the shape of a subject or a part thereof, e.g., the face or the back of a user's head. The outer edge of the body 3 includes the outer edge of the first arm 20, that of the second arm 30, and that of the middle part 40. Along the outer edge of the body 3, the thickness of the body 3 changes continuously and/or smoothly. As illustrated in FIG. 11A, the thickest portions of the body 3, along its outer edge, are located on the first arm 20 and the second arm 30. The inner edge of the body 3 includes the inner edge of the first arm 20, that of the second arm 30, and that of the middle part 40. Along the inner edge of the body 3 (defining the empty space 50 as shown in FIG. 14B), the thickness of the body 3 changes less than that along the outer edge of the body 3. The FIG. 11B shows the underside of the body 3.

As shown in FIG. 11B, the middle part 40 includes a plurality of openings 3A. The plurality of openings 3A extend partially through the width of the middle part 40. The plurality of openings 3A do not extend through the entire width of the middle part 40. The plurality of openings 3A extend partially through the thickness of the middle part 40. The plurality of openings 3A do not extend through the entire thickness of the middle part 40. The plurality of openings 3A may facilitate the first arm 20 and the second arm 30 to deflect when a force is applied to the upper side of the body 3 of the cushion 1, such that the cushion 1 may wrap around or cradle a subject or a part thereof, e.g., the head (the face or the back of the head) of the user. This is further illustrated in FIGS. 13A through 15B. The underside of the body 3 may be substantially flat. The body 3 of the cushion 1 may be made of a material such as, for example, foam, rubber, or the like. Merely by way of example, the body 3 may be made of memory foam, e.g., polyurethane foam.

Figure 12A:
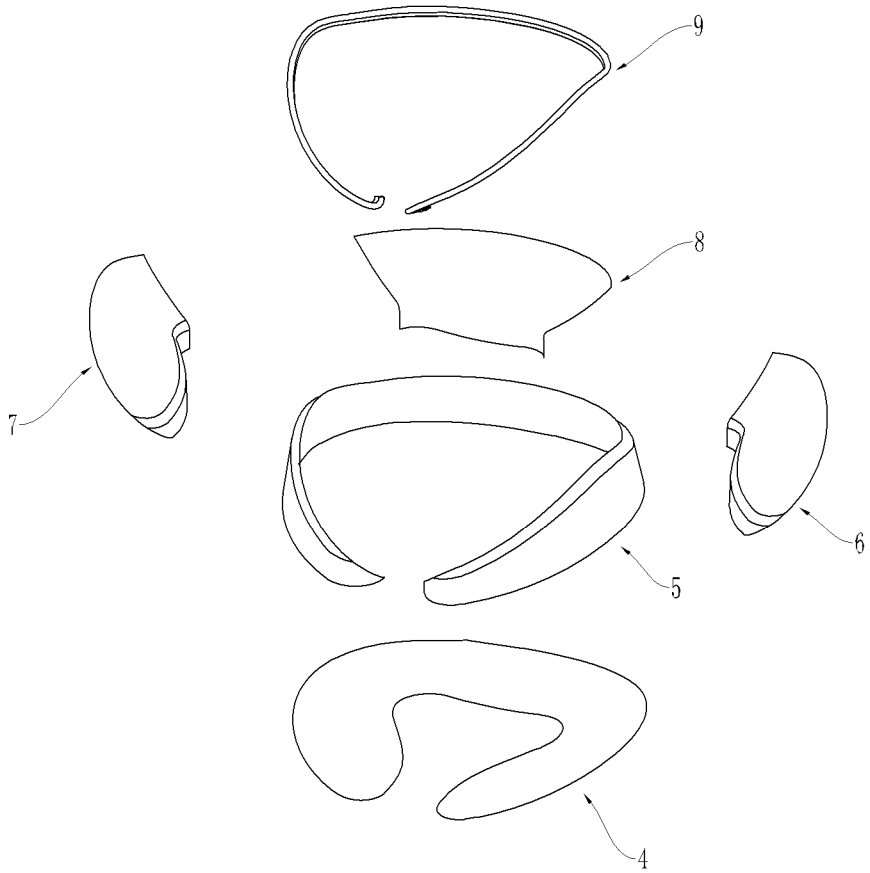
FIG. 12A is an exploded view of an exemplary cover of the exemplary cushion illustrated in FIGS. 10A-10C according to some embodiments of the present teachings.
Figure 12B:
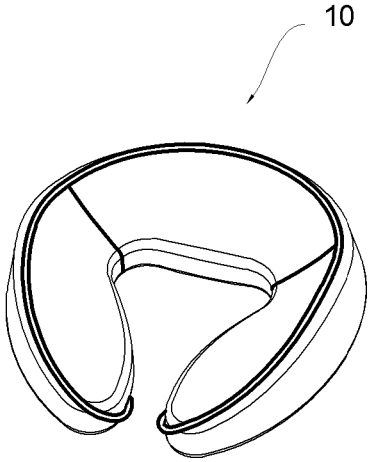
FIG. 12B shows a perspective view of the exemplary cover when these pieces shown in FIG. 12A are put together according to some embodiments of the present teachings.

FIG. 12A is an exploded view of an exemplary cover 10 of the exemplary cushion 1. The cover includes a bottom piece 4, a side piece 5, an upper right piece 6, an upper left piece 7, an upper middle piece 8, and a decoration line 9. FIG. 12B shows a perspective view of the exemplary cover 10 when these pieces shown in FIG. 12A are put together. The cover may be made of at least one material selected from cloth, paper, plastic, leather, polyester, or the like. The cover may be disposable or reusable.

Figure 13A:
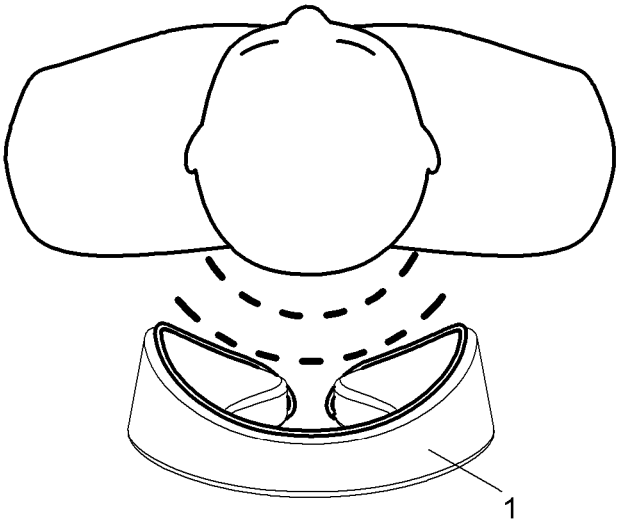
FIGS. 13A and 13B show that the contour of the upper side of an exemplary cushion according to some embodiments of the present teachings.
Figure 13B:
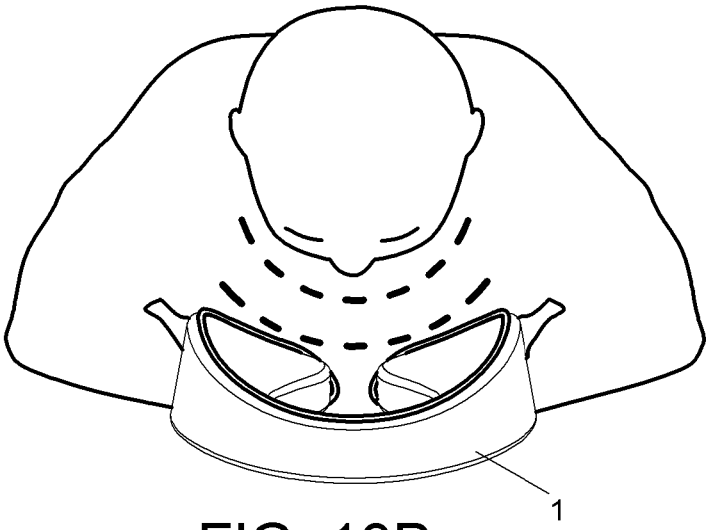

FIGS. 13A and 13B show that the contour of the upper side of the cushion 1, which is essentially the same as the contour of the body 40 of the cushion 1, when there is no force applied to the cushion 1. FIG. 13A shows that the contour of the upper side of the cushion 1 matches the shape of the back of the user's head well. FIG. 13B shows that the contour of the upper side of the cushion 1 matches the shape of the user's face (or the shape of the user's cheeks) well.

Figure 14A:
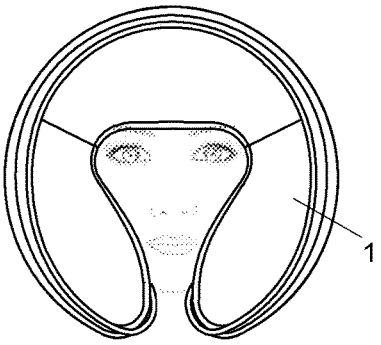
FIGS. 14A and 14B show the empty space in the middle of an exemplary cushion according to some embodiments of the present teachings.
Figure 14B:
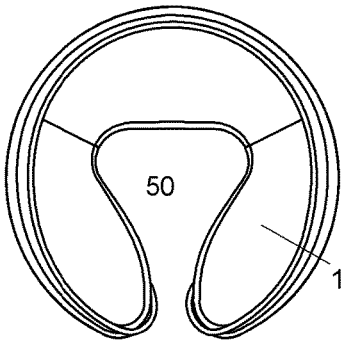

FIGS. 14A and 14B show the empty space 50 in the middle of the exemplary cushion 1. The empty space 50 may accommodate a subject or a portion thereof. Merely by way of example, the subject is a user. The empty space 20 may accommodate the nose, the mouth, and/or the eyes of the user if the user faces downward such that the user's face contacts the cushion 1. The empty space 50 may accommodate a portion of the back of the user's head, if the user faces upward such that the back of the user's head contacts the cushion 1. If the cushion 1 is used as a neck pillow, the empty space 50 may accommodate the user's neck such that the cushion 1 wraps around the user's neck.

Figure 15A:
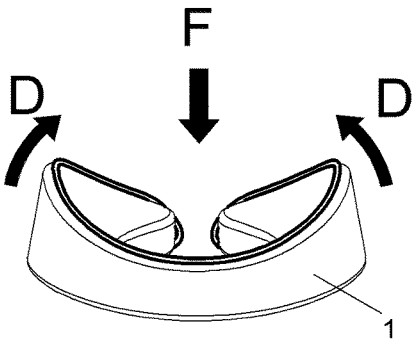
FIGS. 15A and 15B show the deflection of an exemplary cushion when a force is applied to the cushion according to some embodiments of the present teachings.
Figure 15B:
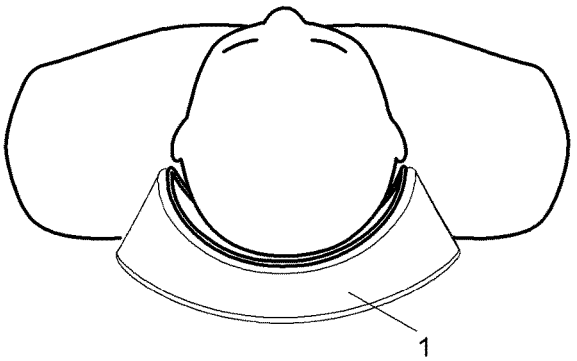

FIGS. 15A and 15B show that the arms of the cushion (or the arms 20 and 30 of the body 3 of the cushion 1) deflect upward and inward as indicated by the two arrows D when a force F is applied to the cushion 1. As shown in FIG. 15B, the deflected cushion 1 cradles the back of the user's head.

In some embodiments, a cushion is provided. The cushion includes a body having an upper side and an underside. The body includes a first arm, a second arm, and a middle part. The middle part, along the length thereof, may be positioned substantially between and integrally formed with the first arm and the second arm. The upper side of the cushion is contoured such that it matches the contact surface of an intended subject, or a part thereof, well. The intended subject may be a person or user, or an object other than a person. The contact surface may be, e.g., a face or the back of the head of a user, or a part thereof. The middle part has a thickness, a length, and a width. The middle part, along the length of the middle part, is positioned substantially between and integrally formed with the first arm and the second arm. The middle part may include an opening on the underside of the body of the cushion. The middle part may include more than one opening on the underside of the body of the cushion. The one or more of openings may facilitate the first arm and the second arm to deflect when a force is applied to the upper side of the body. The one or more openings extend partially through the width of the middle part. The one or more openings extend partially through the thickness of the middle part. The one or more openings extend through the entire width of the middle part. The one or more openings extend through the entire thickness of the middle part. The body may be made of a material such as, for example, foam, rubber, or the like. Merely by way of example, the body 3 may be made of memory foam, e.g., polyurethane foam. The cushion may include an empty space in the middle such that the empty space may accommodate a subject or a portion thereof. The cushion may include a cover. The cover may be made of at least one material selected from cloth, paper, plastic, leather, polyester, or the like. The cover may be disposable or reusable.

In some embodiments, a cushion is used in connection with a cradle frame to form a cradle. The support assembly of the cradle frame may include one or more patches of reusable hook-and-loop fasteners on the side sections and/or the middle section of the support assembly. The cushion may include one or more complimentary patches of reusable hook-and-loop fasteners on the two arms and/or the middle part. When there is no force applied to the cushion, two arms of the cushion may temporarily bind, via the complimentary patches of reusable hook-and-loop fasteners on the two arms of the cushion, to the support assembly, via the patches on the upper side of the first side section and the upper side of the second side section, respectively. In some embodiments, the middle part of the cushion does not bind to the middle section of the support assembly where the middle section is curved, e.g., downward. When a force is applied to the cushion (e.g., when a user rests his/her head on the cushion of the cradle, and/or when another person, e.g., a masseur, applies a force to the user who rests his/her head on the cradle), the two arms of the cushion that originally bind to the first side section and the second side section of the support assembly may deflect upward and inward, and partially separate the binding between the two arms of the cushion and the first side section and the second side section of the support assembly. The force may push the middle part of the cushion downward. If the force is large enough, the middle part of the cushion may touch the upper side of the middle section of the support assembly such that the middle part of the cushion binds temporarily, via the complimentary patch of a reusable hook-and-loop fastener on the middle part of the cushion, to the middle section of the support assembly, via the patch on the upper side of the middle section. The downward curve of the middle section may facilitate the middle part of the cushion to move downward when the force is applied. If the support assembly includes a ribbon or band as already discussed, the length of the portion of the ribbon or band, located between the first side section and the second side section and substantially above the middle section of the support assembly, may be adjusted. The length of the portion of the ribbon or band may affect the stiffness of the cushion, or how much force is needed to push the cushion down toward the middle section of the support assembly. The contour of the upper side of the cushion may be such that it matches the contact surface of an intended subject, or a part thereof, well. The intended subject may be a person or user, or an object other than a person. The contact surface may be, e.g., a face or the back of a user, or a part thereof.

Figure 16:
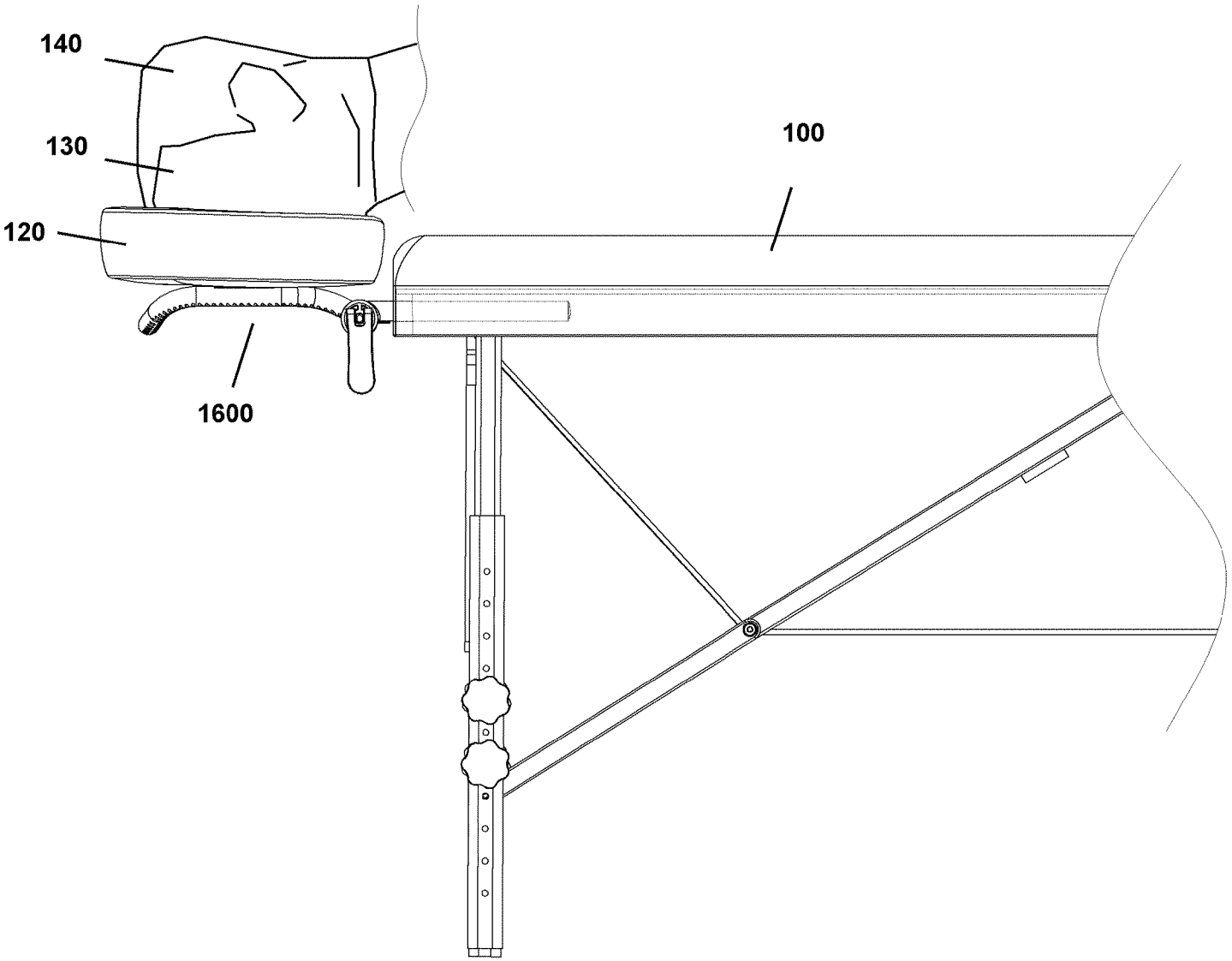
FIG. 16 is a simplified side view of a portion of a table with a cradle frame and a cushion according to some embodiments of the present teachings.

FIG. 16 is a simplified side view of a portion of a table 100 with a cradle frame 1600 and a cushion 120. The table 100 includes a surface on which the body of a user (the body of the user not shown in FIG. 16) is supported, and the cradle frame 1600 and the cushion 120 for supporting the head 140 of the user. As illustrated, the user is facing downward so that the user's face 130 is in contact with the cushion 120. The cradle frame 1600 is coupled to the table 100. The cushion 120 is placed on the cradle frame 1600. As used herein, the head of a user includes both the face and the back of the head of the user. The cradle frame and/or the cushion disclosed herein is suitable for use both when a user is facing upward and when the user is facing downward. A cradle frame and/or a cushion disclosed herein may be used in connection with a structure other than a table as illustrated in FIG. 16. Merely by way of example, a cradle frame and/or a cushion may be coupled to a chair, a wall, etc. A cradle frame and/or a cushion may be used to support a subject, or a part of a subject. The subject may be a person, or an object other than a person.

FIGS. 17A-19B illustrate an exemplary cradle frame having various features described in the present teachings. A cushion is shown in some of these figures as well. The exemplary cradle frames illustrated in FIGS. 17A-19B are essentially symmetric except for some differences. Some of the differences include that the latch 1720 is located closer to the first side section 1701 of the support assembly 1710 than to the second side section 1702 of the support assembly 1710. It is understood that it is not intended to limit the scope of the application.

Figure 17A:
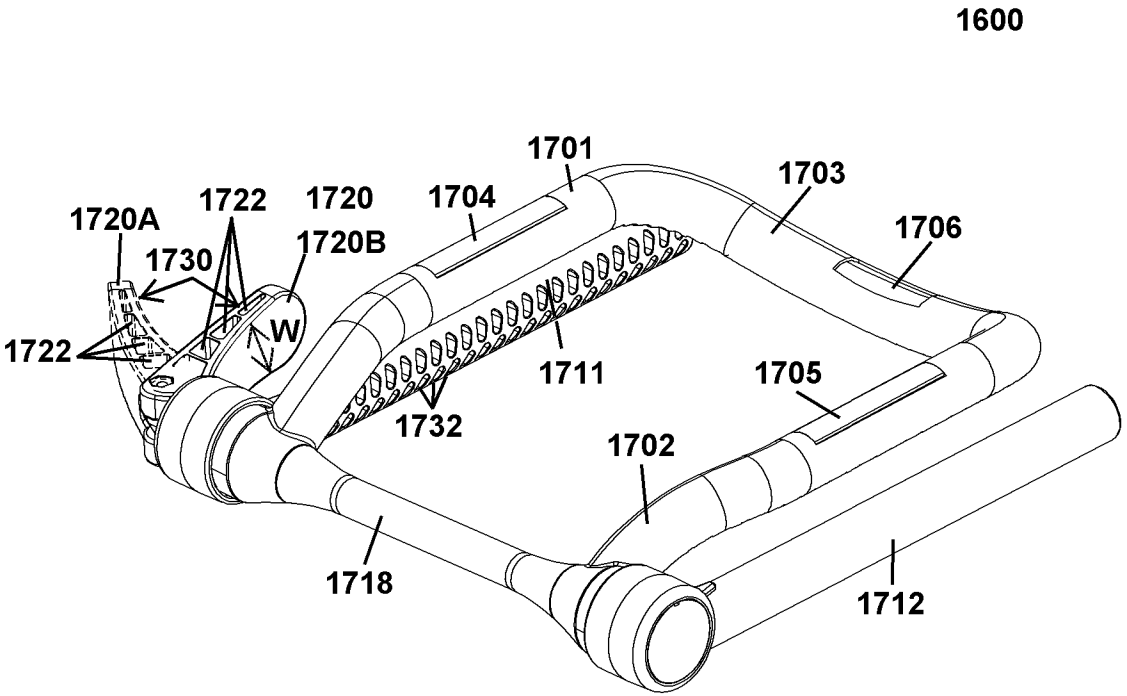
FIG. 17A shows an exemplary cradle frame with the beams of the connection assembly in a folded configuration according to some embodiments of the present teachings.
Figure 17B:
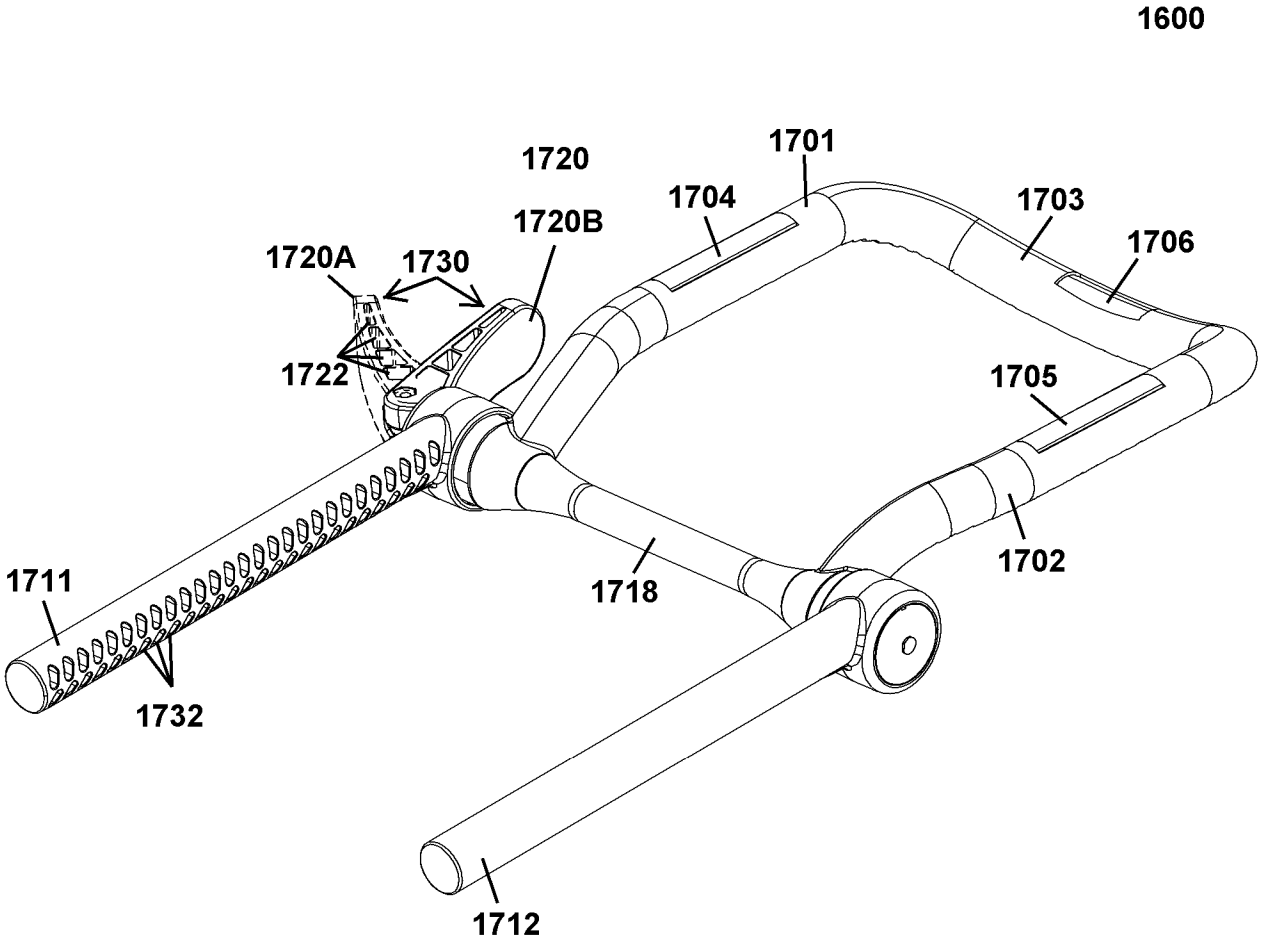
FIG. 17B shows an exemplary cradle frame with the beams of the connection assembly in an unfolded configuration according to some embodiments of the present teachings.
Figure 17C:
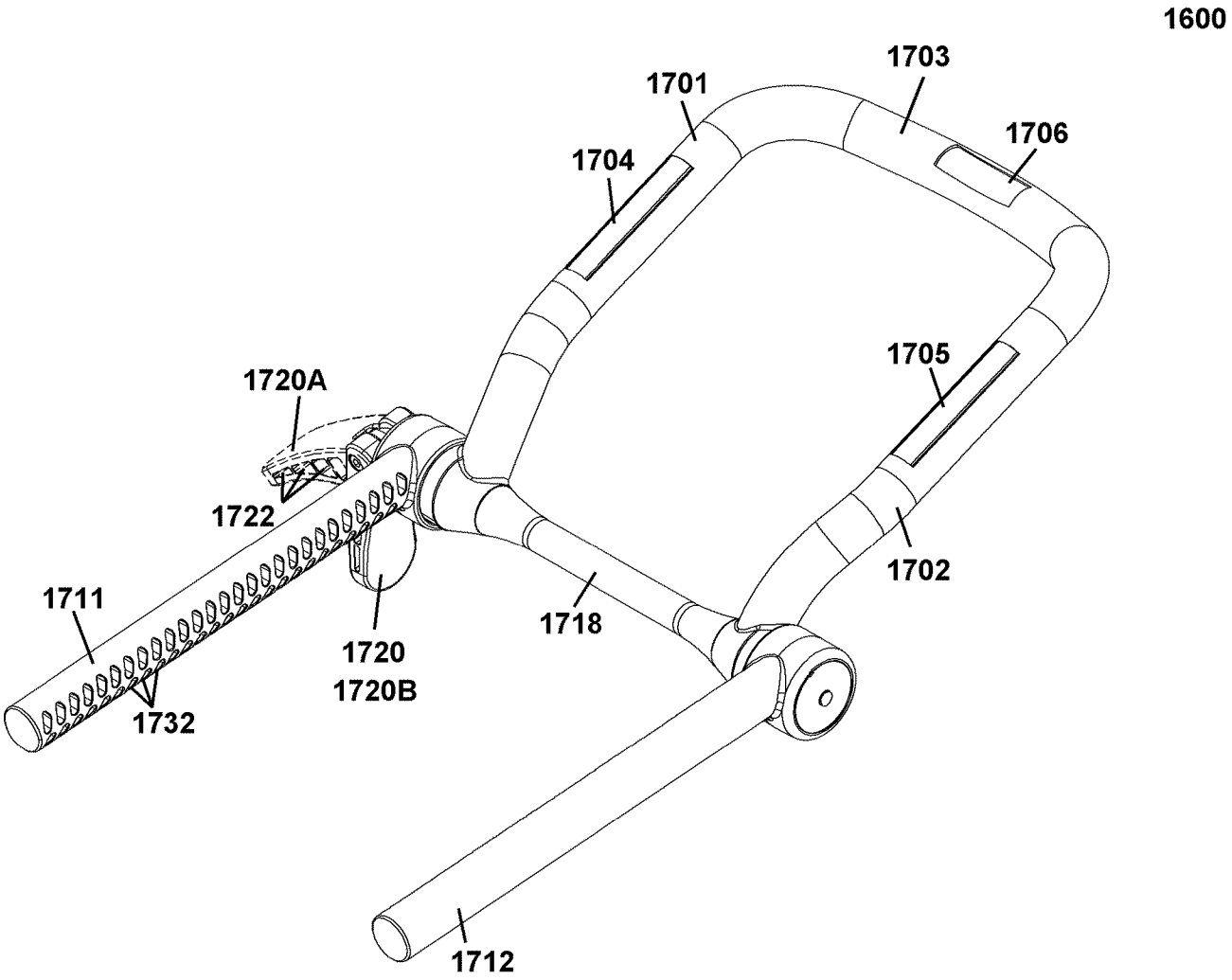
FIGS. 17C and 17D show an exemplary cradle frame with the beams of the connection assembly in an unfolded configuration according to some embodiments of the present teachings.
Figure 17D:
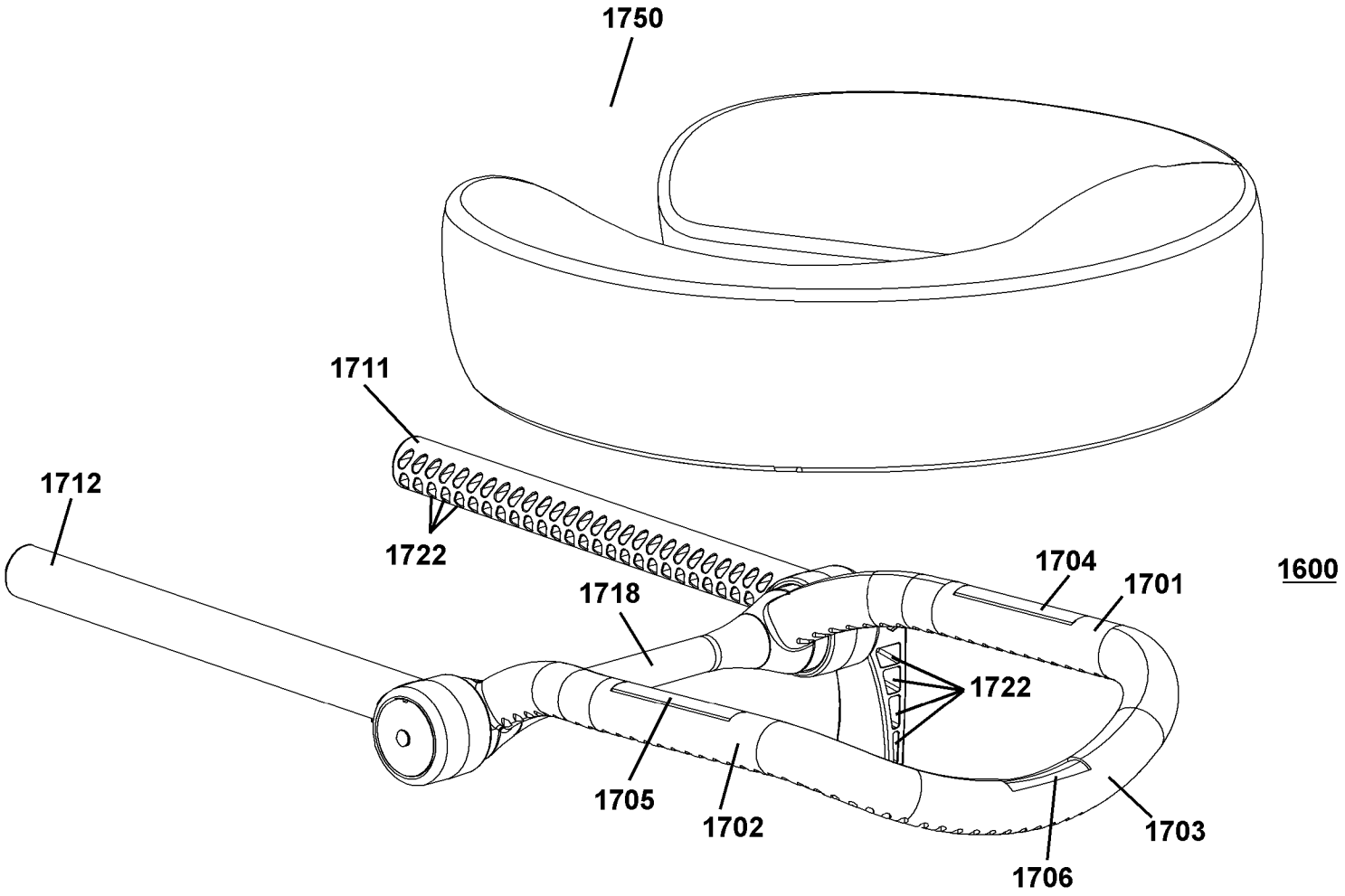

FIGS. 17A-17D illustrate perspective views of the exemplary cradle frame 1600. As illustrated, the exemplary cradle frame includes a support assembly 1710 (see FIG. 19A), a gear assembly, and a connection assembly. FIG. 17A shows the exemplary cradle frame with the beams 1711 and 1712 of the connection assembly in a folded configuration for, e.g., storage and/or transportation purposes. FIG. 17B shows the exemplary cradle frame in a lower (or unraised) position with the beams 1711 and 1712 of the connection assembly in an unfolded configuration, extended for coupling the cradle frame to a structure, e.g., the table 100 shown in FIG. 16. FIGS. 17C and 17D show the exemplary cradle frame with the beams 1711 and 1712 of the connection assembly in an unfolded configuration, extended for coupling the cradle frame to a structure, e.g., the table 100 shown in FIG. 16. FIG. 17D also shows a cushion 1750 that may be used with the cradle frame. At least one of the support assembly 1710, a gear assembly, and a connection assembly, or components of any one of these assemblies may be made of a rigid material. Merely by way of example, the first side section 1701, the second side section 1702, and the middle section 1703 of the support assembly 1710 may be an integral piece made of, e.g., plastic, wood, metal, or the like. Plastic may include, e.g., nylon (e.g., PA6), or at least one of other types of polymers.

FIG. 17A shows the exemplary cradle frame with the beams 1711 and 1712 of the connection assembly in a folded configuration for, e.g., storage and/or transportation purposes. As shown in the figure, the support assembly 1710 includes a first side section 1701, a second side section 1702, and a middle section 1703. The middle section 1703 is positioned substantially between and integrally formed with the first side section 1701 and the second side section 1702. The middle section 1703 is curved, e.g., downward. The first side section 1701 is substantially parallel to the second side section 1702 along the length of both side sections. The first side section 1701, along its length, may be substantially straight. The second side section 1702, along its length, may be substantially straight. In this direction, the middle section 1703 does not extend beyond the length of the first side section 1701 or the length of the second side section 1702. The support assembly 1710 has an upper side and an underside. The upper side of the support assembly 1710 is formed of the upper side of the first side section 1701, that of the second side section 1702, and that of the middle section 1703. The underside of the support assembly 1710 is formed of the underside of the first side section 1701, that of the second side section 1702, and that of the middle section 1703. As illustrated, on the upper sides of the first side section 1701 and the second side section 1702, there are patches 1704 and 1705 of reusable hook-and-loop fasteners, respectively. Any one of the patches 1704 and 1705 may fasten or bind temporarily with a complimentary patch of the reusable hook-and-loop fastener during the time that they are pressed together. On the upper side of the middle section 1703, there may be an area 1706. The area 1706 may include a depression or indentation. The area 1706 may accommodate, e.g., a patch, such as a patch similar to or the same as the patches 1704 and 1705. It is understood that the support assembly 1710 may include more or fewer patches on either one of the first side section 1701, the second side section 1702, or the middle section 1703.

At least part of the support assembly 1710 may include at least one void. The void(s) may be through holes extending through the upper side and the underside of the part of the support assembly 1710. The void(s) may be non-through holes, extending only partially through the upper side and the underside of the part of the support assembly 1710. Merely by way of example, the first side section 1701 may include a plurality of voids on the underside thereof. The voids may be non-through holes. The voids may be arranged in a row, or more than one rows, along at least part of the length of the first side section 1701. The first side section 1701 is substantially parallel to the second side section 1702 along the length of both side sections. At least part of the second side section 1702 and/or the middle section 1703 may also include voids.

The connection assembly includes a first beam 1711, and a second beam 1712, and a beam connector including a shaft sleeve 1718 (described below in connection with FIG. 19A). The support assembly 1710 is connected with or coupled to, pivotally or otherwise, the connection assembly. For example, the first side section 1701 and the second side section 1702 of the support assembly 1710 are connected with or coupled to the beam connector of the connection assembly. At least part of the connection assembly may include at least one void 1732. The void(s) 1732 may be through holes extending through, e.g., the first beam 1711, the second beam 1712, or the beam connector, where the void(s) is or are located. The void(s) 1732 may be non-through holes, extending only partially through, e.g., the first beam 1711, the second beam 1712, or the beam connector, where the void(s) is or are located. Merely by way of example, the first beam 1711 may include a plurality of voids 1732. The voids 1732 may be non-through holes. The voids 1732 may be arranged in a row, or more than one rows, along at least part of the length of the first beam 1711. The first beam 1711 is substantially parallel to the second beam 1712 along the length of both beams. The voids 1732 may be located on the side of the first beam 1711 facing the second beam 1712 (referred to as the inner side of the first beam 1711). The voids 1732 may be located on another side of the first beam 1711, e.g., the outer side (opposite to the inner side), the upper side or the underside of the first beam 1711, or more than one side of the first beam 1711. The upper side of the first beam 1711 may face essentially the same direction as the upper side of the first side section 1701 when the first beam 1711 is in its unfolded configuration (as illustrated in FIG. 17B); the underside of the first beam 1711 is opposite to its upper side. Likewise, the upper side of the second beam 1712 may face essentially the same direction as the upper side of the second side section 1702 when the second beam 1712 is in its unfolded configuration (as illustrated in FIG. 17B); the underside of the second beam 1712 is opposite to its upper side. At least part of the second beam 1712 and/or the beam connector may also include one or more voids 1732.

The gear assembly may control, e.g., lock or unlock, the relative positioning of the support assembly 1710 of the cradle frame relative to, e.g., the beam connector or the table 100 shown in FIG. 16. Part of the gear assembly, a latch 1720, is shown in FIG. 17A. The latch 1720 may move in the directions as indicated by 1730, between an unlocked position 1720A as illustrated in phantom and a locked position 1720B. When the latch 1720 is in the unlocked position 1720A, the gear assembly allows for the movements of at least one of the parts including the first side section 1701, the second side section 1702 of the support assembly 1710, and the first beam 1711 and the second beam 1712 of the connection assembly; while when the latch 1720 is in the locked position 1720B, the gear assembly prevents the movements of these parts. The latch 1720 may include one or more void areas 1722. The void areas 1722 may include through holes, extending through the latch 1720 along one direction, e.g., the width direction W. The void areas 1722 may include non-through holes, extending only partially through the latch 1720 along one direction, e.g., the width direction W. The void areas 1722 may extend through or partially through the latch 1720 along a direction other than the width direction W.

FIG. 17B shows an exemplary cradle frame in a lower (or unraised) position with the beams 1711 and 1712 of the connection assembly in an unfolded configuration. As illustrated, the beams 1711 and 1712 are extended for coupling the cradle frame to a structure, e.g., the table 100 shown in FIG. 16. In this lower position, the first side section 1701 substantially aligns with the first beam 1711; likewise, the second side section 1702 substantially aligns with the second side beam 1712. The first beam 1711 and the second beam 1712 of the connection assembly are substantially parallel to each other. The first beam 1711 and the second beam 1712 as illustrated are substantially straight. It is understood that in other embodiments, one or both of the first beam 1711 and the second beam 1712 may be curved.

FIG. 17C shows an exemplary cradle frame in a raised position with the beams 1711 and 1712 of the connection assembly in an unfolded configuration. As illustrated, the beams 1711 and 1712 are extended for coupling the cradle frame to a structure, e.g., the table 100 shown in FIG. 16. In this higher (or raised) position, the first side section 1701 does not align with the first beam 1711; likewise, the second side section 1702 does not align with the second beam 1712. The beam connector including the shaft sleeve 1718 is located below or underneath the support assembly.

FIG. 17D shows an exemplary cradle frame with the beams 1711 and 1712 of the connection assembly in an unfolded configuration. FIG. 17D also shows the cushion 1750. The cushion 1750 shown in FIG. 17D may be put on the upper side of the support assembly 1710. The cushion 1750 may include one or more complimentary patches of reusable hook-and-loop fasteners that may fasten or bind temporarily with the patches 1704 and 1705 (and/or 1706 if available), on the upper side of the first side section 1701, and the upper side of the second side section 1702 (and/or the upper side of the middle section 1703 if available), respectively, during the time that the one or more complimentary patches on the cushion and the patches on the support assembly 1710 are pressed together. The patches and the complimentary patches may be separated by, e.g., peeling them apart.

Figure 18A:
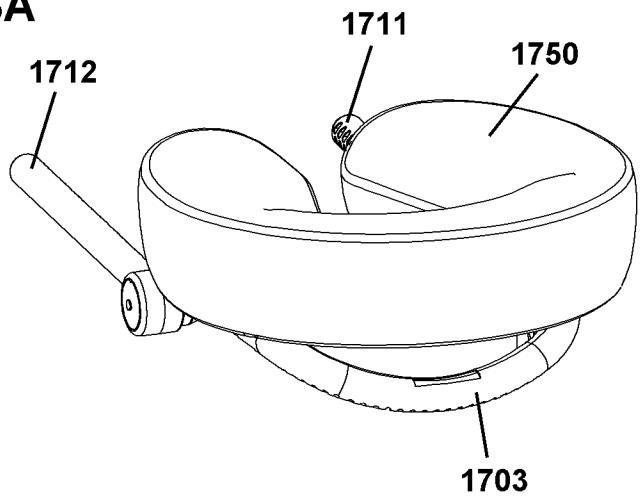
FIGS. 18A-18B show an exemplary cradle frame and a cushion according to some embodiments of the present teachings.
Figure 18B:
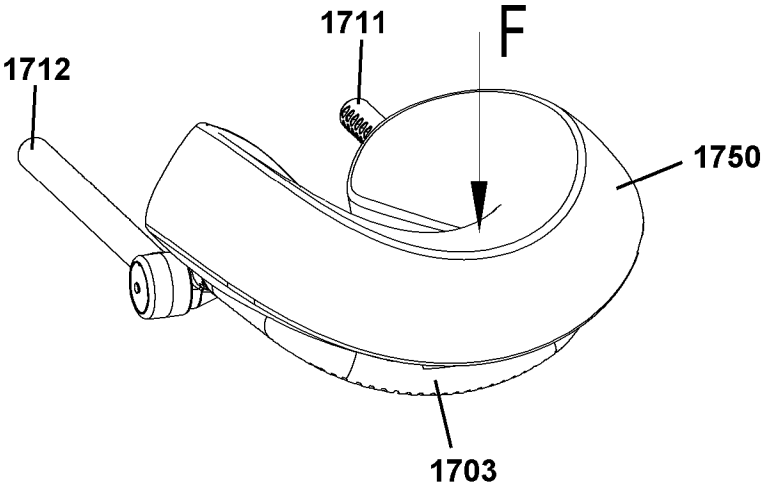

FIGS. 18A and 18B show an exemplary cradle frame and the cushion 1750 when there is no force applied to the cushion 1750 (FIG. 18A) and when a force F is applied to the cushion 1750 (FIG. 18B). In both FIG. 18A and FIG. 18B, the exemplary cradle frame is in a lower (or unraised) position with the beams 1711 and 1712 of the connection assembly in an unfolded configuration, extended for coupling the cradle frame to a structure, e.g., the table 100 shown in FIG. 16. As shown in FIG. 18A, when there is no force applied to the cushion 1750, two arms of the cushion 1750 temporarily bind, via the complimentary patches of reusable hook-and-loop fasteners on the two arms of the cushion 1750 (invisible in FIG. 18A), to the support assembly 1710, via the patches 1704 and 1705 on the upper side of the first side section 1701 and the upper side of the second side section 1702, respectively. The middle part of the cushion 1750 does not bind to the middle section 1703 of the support assembly 1710 where the middle section 1703 is curved, e.g., downward. As shown in FIG. 18B, when the force F is applied to the cushion 1750, the two arms of the cushion 1750 that originally bind to the first side section 1701 and the second side section 1702 of the support assembly 1710 deflect, e.g., upward and inward, and partially separate the binding between the two arms of the cushion 1750 and the first side section 1701 and the second side section 1702 of the support assembly 1710. The force F pushes the middle part of the cushion 1750 downward toward the middle section 1703 of the support assembly 1710. If there is a patch located at 1706 of the middle section 1703, the cushion 1750 may bind temporarily, via the complimentary patch of a reusable hook-and-loop fastener on the middle part of the cushion 1750 (invisible in FIG. 3B), to the middle section 1703 of the support assembly 1710, via the patch located at 1706 on the upper side of the middle section 1703. The curve, e.g., a downward curve, of the middle section 1703 may facilitate the middle part of the cushion 1750 to move, e.g., downward, when the force F is applied.

Figure 19B:
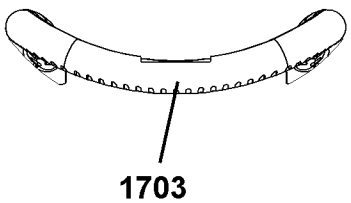
FIG. 19B shows a front view of an exemplary support assembly.
Figure 19A:
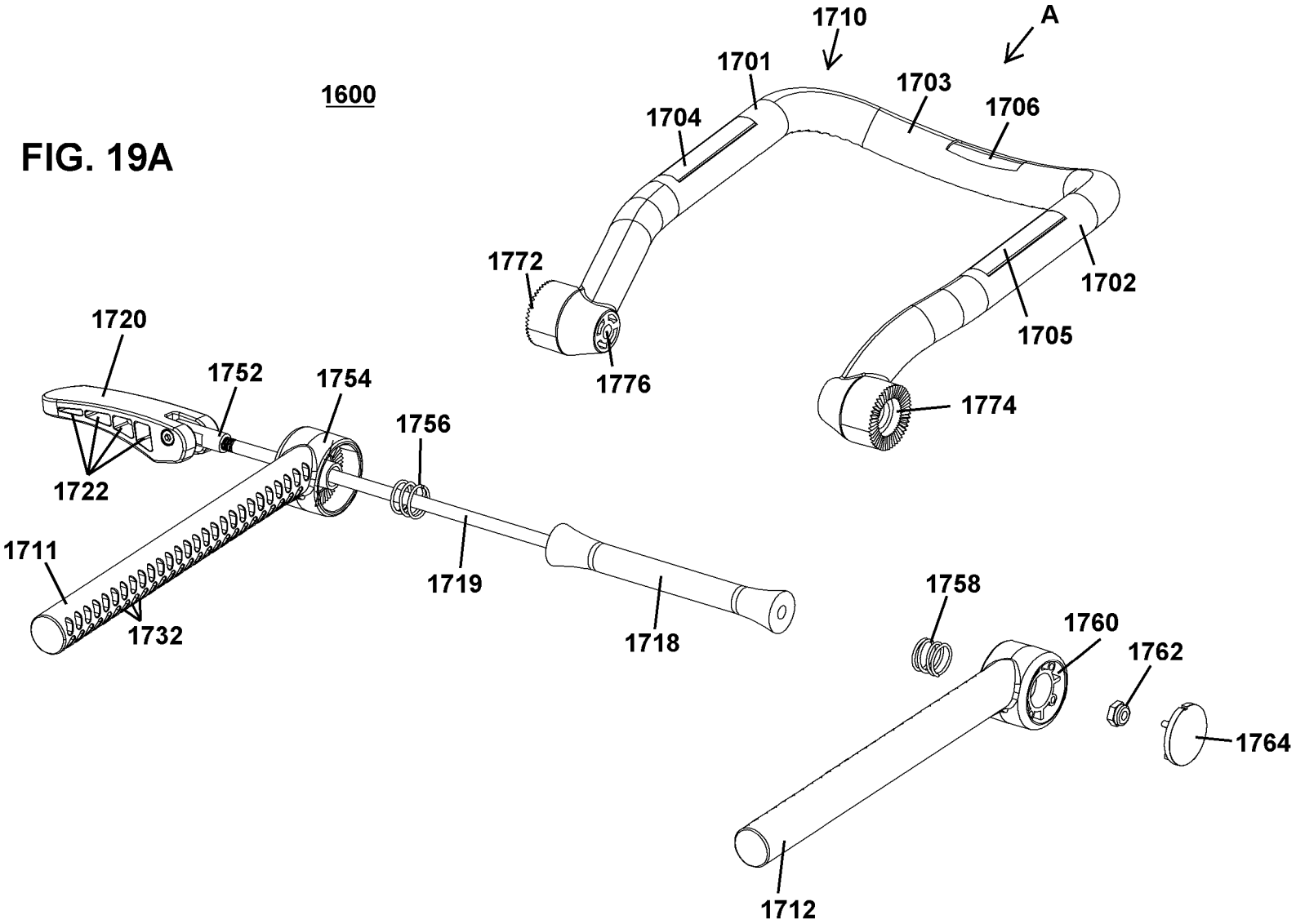
FIG. 19A shows an exploded view of an exemplary cradle frame according to some embodiments of the present teachings.

FIG. 19A shows an exploded view of an exemplary cradle frame. The support assembly 1710 includes the first side section 1701, the second side section 1702, and the middle section 1703. The patch 1704 of a reusable hook-and-loop fastener is located on the upper side of the first side section 1701. Likewise, the patch 1705 of a reusable hook-and-loop fastener is located on the upper side of the second side section 1702. On the upper side of the middle section 1703, there may be the area 1706. The area 1706 may include a depression or indentation. The area 1706 may accommodate, e.g., a patch, such as one like 1704 or 1705, or a complimentary patch of the patch 1704 or 1705. The cradle frame 1710 may include a cavity for, e.g., holding an agent. The agent may include, e.g., at least one composition selected from the group consisting of a fragrance, an essential oil, and a medication, or the like. The cavity may house a wicking material, and the wicking material is configured to absorb and/or release the agent. Merely by way of example, the civility may be located at the first side section 1701, the second side section 1702, or the middle section 1703, e.g., the underside thereof.

The first side section 1701 may include a small crown gear 1772, and the second side section 1702 may include a small crown gear 1774. The small crown gear 1772 may be integrally formed with the first side section 1701 of the support assembly 1710. Likewise, the small crown gear 1774 may be integrally formed with the second side section 1702 of the support assembly 1710. The small crown gear 1772 may include a slot 1776 for accommodating a double end threaded stud 1719 (discussed below). Although invisible in FIG. 19A, the small crown gear 1774 may include a slot similar to the hole 1776 in the small crown gear 1772 for accommodating the double end threaded stud 1719 (discussed below). FIG. 19B shows a front view (in the A direction) of the exemplary support assembly 1710 illustrated in FIG. 19A.

Returning to FIG. 19A, the connection assembly includes the first beam 1711, the second beam 1712, and the beam connector. The beam connector includes a shaft sleeve 1718 and the double end threaded stud 1719.

The gear assembly includes the latch 1720, an internal thread connector 1752, large crown gears 1754 and 1760, springs 1756 and 1758, a self-locking nut 1762, and a cap 1764. The large crown gear 1754 may be integrally formed with the first beam 1711; likewise, the large crown gear 1760 may be integrally formed with the second beam 1712.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A cradle comprising a cradle frame and a cushion, the cradle frame comprising:

a connection assembly including a first beam, a second beam, and a beam connector, wherein the beam connector couples the first beam and the second beam;

a support assembly including a first side section, a second side section, and a middle section, wherein the middle section is curved and positioned substantially between the first side section and the second side section; and a gear assembly coupled to the support assembly for controlling the positioning of the support assembly relative to the beam connector; and the cushion comprising a body, the body comprising a first arm, a second arm, and a middle part having a thickness, a length, and a width, wherein the middle part, along the length of the middle part, is positioned substantially between and integrally formed with the first arm and the second arm, the middle part comprises at least one opening on the underside of the body, the at least one opening extends partially through the width of the middle part, and the at least one opening extends partially through the thickness of the middle part.

2. The cradle according to claim 1, wherein the middle section of the cradle frame is integrally formed with the first side section and the second side section.

3. The cradle according to claim 1, wherein the first side section or the second side section of the cradle frame comprises a straight portion.

4. The cradle according to claim 1, wherein the first side section or the second side section of the cradle frame comprises a curved portion.

5. The cradle according to claim 1, wherein at least one of the first side section, the second side section, and the middle section of the cradle frame comprises a patch of a reusable hook-and-loop fastener, and the reusable hook-and-loop fastener comprises the patch and a complimentary patch.

6. The cradle according to claim 1, wherein the gear assembly of the cradle frame is coupled to the connection assembly.

7. The cradle according to claim 1, wherein the gear assembly of the cradle frame comprises a latch configured to lock the positioning of the support assembly relative to the beam connector.

8. The cradle according to claim 1, wherein at least one of the connection assembly, the support assembly, and the gear assembly of the cradle frame comprises a rigid material.

9. The cradle according to claim 1, wherein at least a portion of a component of the connection assembly, the support assembly, or the gear assembly of the cradle frame comprises one or more voids.

10. The cradle according to claim 9, wherein the component is the first beam, the second beam, or the beam connector of the connection assembly, or the first side section, the second side section, or the middle section of the support assembly.

11. The cradle according to claim 1, wherein the cradle frame further comprises an adjustment assembly that comprises a first adjustment subassembly and a second adjustment subassembly, wherein the first adjustment subassembly is coupled to the first side section of the support assembly, wherein the second adjustment subassembly is coupled to the second side section of the support assembly, the first adjustment subassembly and the second adjustment subassembly being configured to cooperate to adjust the positioning of the support assembly relative to the beam connector.

12. The cradle according to claim 1, wherein the cradle frame further comprises a cavity for holding an agent, wherein the agent comprises at least one composition selected from the group consisting of: a fragrance, an essential oil, and a medication.

13. The cradle according to claim 12, wherein the cavity houses a wicking material, and the wicking material is configured to absorb or release the agent.

14. The cradle of claim 1, wherein an upper side of the body of the cushion is contoured.

15. The cradle of claim 1, the cushion further comprising a cover.

16. The cradle of claim 1, wherein the cradle frame comprises a patch of a reusable hook-and-loop fastener, and the cushion comprises a complimentary patch of the reusable hook-and-loop fastener.

17. A system comprising a cradle frame coupled to a structure and a cushion, wherein the cradle frame comprises:

a connection assembly for coupling the cradle frame to the structure, wherein the connection assembly comprises a first beam, a second beam, and a beam connector, wherein the beam connector couples the first beam and the second beam;

a support assembly that comprises a first side section, a second side section, and a middle section, wherein the middle section is curved and positioned substantially between the first side section and the second side section; and a gear assembly coupled to the support assembly for controlling the positioning of the support assembly relative to the beam connector; and wherein the cushion comprises:

a first arm, a second arm, and a middle part having a thickness, a length, and a width, wherein the middle part, along the length of the middle part, is positioned substantially between and integrally formed with the first arm and the second arm, the middle part comprises at least one opening, the at least one opening extends partially through the width of the middle part, and the at least one opening extends partially through the thickness of the middle part.

18. The system of claim 17, wherein the cradle frame further comprises an adjustment assembly that comprises a first adjustment subassembly and a second adjustment subassembly, wherein the first adjustment subassembly is coupled to the first side section of the support assembly, wherein the second adjustment subassembly is coupled to the second side section of the support assembly, the first adjustment subassembly and the second adjustment subassembly being configured to cooperate to adjust the positioning of the support assembly relative to the beam connector.

19. The system of claim 17, wherein the structure is a bed, a table, or a chair.

* * * * *